US009046800B2

(12) United States Patent
Hotta et al.

(10) Patent No.: US 9,046,800 B2
(45) Date of Patent: Jun. 2, 2015

(54) MAGNETIC CARRIER

(75) Inventors: Yojiro Hotta, Mishima (JP); Naoki Okamoto, Mishima (JP); Kazuo Terauchi, Numazu (JP); Ryuichiro Matsuo, Moriya (JP); Tetsuya Ida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/114,610

(22) PCT Filed: Apr. 25, 2012

(86) PCT No.: PCT/JP2012/061626

§ 371 (c)(1),
(2), (4) Date: Oct. 29, 2013

(87) PCT Pub. No.: WO2012/153696

PCT Pub. Date: Nov. 15, 2012

(65) Prior Publication Data

US 2014/0051023 A1 Feb. 20, 2014

(30) Foreign Application Priority Data

May 12, 2011 (JP) ..... 2011-107073

(51) Int. Cl.
*G03G 9/113* (2006.01)
*G03G 9/083* (2006.01)

(52) U.S. Cl.
CPC ..... *G03G 9/0839* (2013.01); *G03G 9/1132* (2013.01); *G03G 9/1139* (2013.01)

(58) Field of Classification Search
CPC ..... G09G 9/1139; G09G 9/1132
USPC ..... 430/111.35, 111.32
See application file for complete search history.

(56) References Cited

U.S. PATENT DOCUMENTS

| | | | |
|---|---|---|---|
| 5,665,513 | A | 9/1997 | Ida et al. |
| 5,700,617 | A | 12/1997 | Takiguchi et al. |
| 5,747,209 | A | 5/1998 | Takiguchi et al. |
| 5,795,693 | A | 8/1998 | Okado et al. |
| 5,851,714 | A | 12/1998 | Taya et al. |
| 5,912,099 | A | 6/1999 | Kanbayashi et al. |
| 5,994,018 | A | 11/1999 | Iida et al. |
| 6,001,525 | A | 12/1999 | Ida et al. |
| 6,013,402 | A | 1/2000 | Kanbayashi et al. |
| 6,022,659 | A | 2/2000 | Kanbayashi et al. |
| 6,146,801 | A | 11/2000 | Ichikawa et al. |
| 6,316,156 | B1 | 11/2001 | Takiguchi et al. |
| 6,528,222 | B2 | 3/2003 | Kohtaki et al. |
| 6,586,147 | B2 | 7/2003 | Iida et al. |
| 6,641,967 | B2 | 11/2003 | Takiguchi et al. |
| 6,751,424 | B2 | 6/2004 | Komatsu et al. |
| 6,808,852 | B2 | 10/2004 | Hotta et al. |
| 6,929,894 | B2 | 8/2005 | Sugahara et al. |
| 7,022,449 | B2 | 4/2006 | Sugahara et al. |
| 7,112,395 | B2 | 9/2006 | Ida et al. |
| 7,115,349 | B2 | 10/2006 | Iida et al. |
| 7,138,213 | B2 | 11/2006 | Itakura et al. |
| 7,144,668 | B2 | 12/2006 | Baba et al. |
| 7,147,980 | B2 | 12/2006 | Itakura et al. |
| 7,160,662 | B2 | 1/2007 | Yoshino et al. |
| 7,244,539 | B2 | 7/2007 | Baba et al. |
| 7,288,348 | B2 | 10/2007 | Hayami et al. |
| 7,300,733 | B2 | 11/2007 | Sugahara et al. |
| 7,361,400 | B2 | 4/2008 | Shimamura et al. |
| 7,396,626 | B2 | 7/2008 | Fujikawa et al. |
| 7,396,629 | B2 | 7/2008 | Baba et al. |
| 7,452,647 | B2 | 11/2008 | Hayami et al. |
| 7,455,947 | B2 | 11/2008 | Ida et al. |
| 7,527,908 | B2 | 5/2009 | Iwatsuki et al. |
| 7,544,457 | B2 | 6/2009 | Hashimoto et al. |
| 7,611,813 | B2 | 11/2009 | Ida et al. |
| 7,629,100 | B2 | 12/2009 | Okamoto et al. |
| 7,767,370 | B2 | 8/2010 | Ishigami et al. |
| 7,816,063 | B2 | 10/2010 | Hashimoto et al. |
| 7,906,262 | B2 | 3/2011 | Ishigami et al. |
| 8,114,562 | B2 | 2/2012 | Ishigami et al. |
| 8,142,972 | B2 | 3/2012 | Hotta et al. |
| 8,298,742 | B2 | 10/2012 | Okamoto et al. |
| 2007/0003854 | A1 | 1/2007 | Matsui |
| 2009/0047594 | A1* | 2/2009 | Hirakawa ..... 430/111.1 |
| 2010/0248126 | A1 | 9/2010 | Ishigami et al. |
| 2010/0273103 | A1 | 10/2010 | Baba et al. |
| 2010/0310978 | A1 | 12/2010 | Endo et al. |
| 2011/0097661 | A1 | 4/2011 | Ishigami et al. |
| 2011/0236813 | A1* | 9/2011 | Kiyono et al. ..... 430/105 |
| 2013/0344430 | A1 | 12/2013 | Terauchi et al. |
| 2014/0038098 | A1 | 2/2014 | Naka et al. |
| 2014/0099577 | A1 | 4/2014 | Moribe et al. |
| 2014/0099578 | A1 | 4/2014 | Hotta et al. |

FOREIGN PATENT DOCUMENTS

| | | | |
|---|---|---|---|
| JP | 10-83120 | A | 3/1998 |
| JP | 2003-192940 | * | 7/2003 |
| JP | 2004-347654 | A | 12/2004 |
| JP | 2006-313323 | A | 11/2006 |
| JP | 2007-41549 | A | 2/2007 |

OTHER PUBLICATIONS

AIPN Japanese Patent Office machine-assisted translation of JP 2003-192940 (pub. Jul. 2003).*
Fukudome, et al., U.S. Appl. No. 14/095,963, filed Dec. 3, 2013.
PCT International Search Report and Written Opinion of the International Searching Authority, International Application No. PCT/JP2012/061626, Mailing Date Jul. 3, 2012.

* cited by examiner

*Primary Examiner* — Janis L Dote
(74) *Attorney, Agent, or Firm* — Fitzpatrick, Cella, Harper and Scinto

(57) ABSTRACT

Provided is the following magnetic carrier. The magnetic carrier maintains high developing performance even when the number of sheets to be output is large. Its charge-providing performance hardly reduces even when toner or an external additive is spent on the magnetic carrier. In addition, the magnetic carrier is strong in resistance against standing. The magnetic carrier includes a magnetic carrier core and a resinous coating layer formed on a surface of the magnetic carrier core, in which the resinous coating layer contains a resin composition and silica-alumina composite particles.

4 Claims, 5 Drawing Sheets

MAGNETIC CARRIER

TECHNICAL FIELD

The present invention relates to a magnetic carrier to be used in a two-component developer for developing an electrostatic latent image formed on an electrostatic latent image-bearing member, which is an electrophotographic photosensitive member or an electrostatic recording dielectric, in an electrophotographic method.

BACKGROUND ART

Higher speed and higher reliability of a copying apparatus or a printer have been strictly sought in recent years. Meanwhile, the main body of the copying apparatus has started to be constructed of simpler components in various respects. As a result, performance demanded for a developer has become more sophisticated. Accordingly, unless an improvement in the performance of the developer can be achieved, a more excellent main body of the copying apparatus does not become viable nowadays.

Of the methods each involving developing an electrostatic latent image formed on an electrostatic latent image-bearing member with toner, a two-component developing method involving using a two-component developer obtained by mixing the toner with a magnetic carrier has been suitably employed in a full-color copying machine or printer required to provide high image quality. In the two-component developing method, the magnetic carrier provides the toner with a proper quantity of positive or negative charge through triboelectric charging, and the magnetic carrier carries the toner on its surface by means of the electrostatic attraction of the triboelectric charging.

Although various characteristics are demanded for the magnetic carrier and the toner constituting the two-component developer, characteristics particularly important for the magnetic carrier are, for example, proper charge-providing performance, resistance against an alternating voltage, impact resistance, wear resistance, resistance against spent toner, and developing performance.

These days, load on the developer in a developing unit has a tendency to increase. For example, a reduction in developer volume occurs in association with a reduction in size of the developing unit, or the speed when the developer is stirred increases owing to an increase in the output speed of the unit. As a result, when the life of the developer comes to close, i.e., the toner or an external additive is spent on the surface of the magnetic carrier, the charge-providing performance of the magnetic carrier is reduced.

To alleviate the problem, Patent Literature 1 proposes the following magnetic carrier. Fine particles are caused to adhere to the surface of the magnetic carrier provided with a coating layer made of a resin component. The magnetic carrier suppresses the adhesion of an external additive at the time of endurance by embedding silica fine particles in the recesses of the magnetic carrier. However, silica precludes the impartment of a dielectric characteristic to the magnetic carrier, and hence it is difficult to maintain the charge-retaining ability of the magnetic carrier particularly under high temperature and high humidity.

Further, Patent Literature 2 proposes that a high-dielectric substance be incorporated into the coating layer of a magnetic carrier to allow the magnetic carrier to maintain its developing performance and endurance stability. As the magnetic carrier uses a dielectric having a high dielectric constant, the charge-retaining ability of the magnetic carrier is improved.

However, the specific gravity of the high-dielectric substance is so heavy that it is difficult to disperse the substance in the coating layer. As a result, its segregation or desorption occurs, thereby making it difficult to obtain stable quality.

CITATION LIST

Patent Literature

PTL 1: Japanese Patent Application Laid-Open No. 2007-41549

PTL 2: Japanese Patent Application Laid-Open No. H10-83120

SUMMARY OF INVENTION

Technical Problem

An object of the present invention is to provide the following magnetic carrier. The magnetic carrier maintains high developing performance even when printing is performed on a large number of sheets, and its charge-providing performance hardly reduces even after the carrier has been left to stand for a long time period.

Solution to Problem

The present invention relates to a magnetic carrier, including: a magnetic carrier core; and a resinous coating layer formed on a surface of the magnetic carrier core, in which the resinous coating layer contains a resin composition and silica-alumina composite particles.

Advantageous Effects of Invention

According to the present invention, the following magnetic carrier can be provided. The magnetic carrier maintains high developing performance even when printing is performed on a large number of sheets, and its charge-providing performance hardly reduces even after the carrier has been left to stand for a long time period.

Further features of the present invention will become apparent from the following description of exemplary embodiments with reference to the attached drawings.

DESCRIPTION OF EMBODIMENTS

Figure 1:
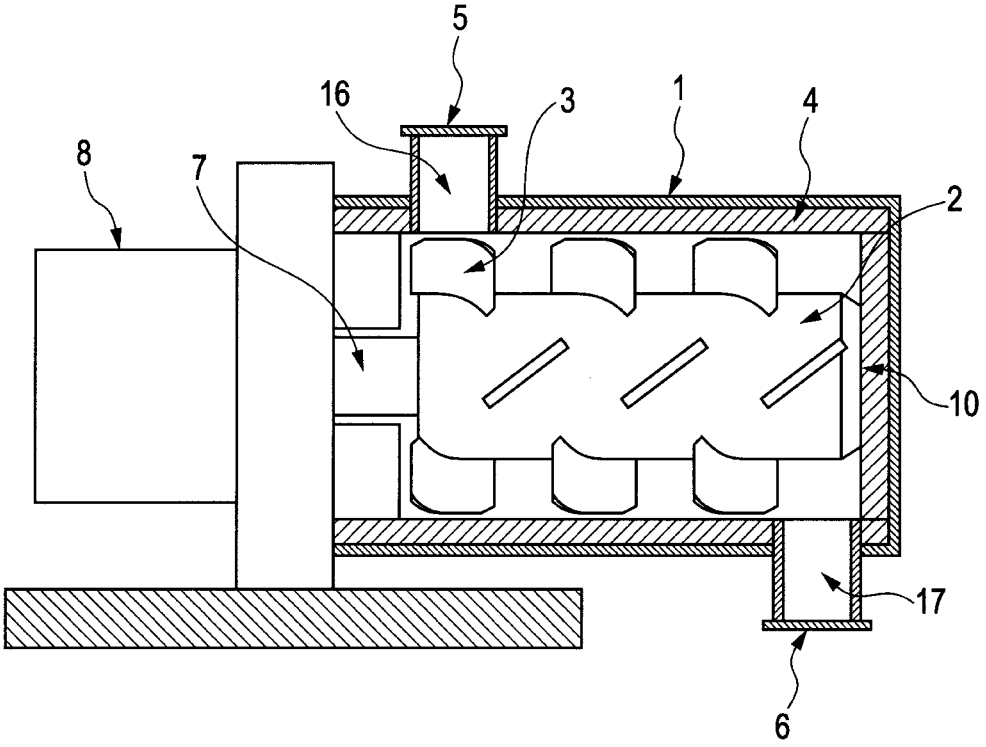
FIG. 1 is a schematic view illustrating an example of a coating treatment apparatus that can be used in the production of a magnetic carrier.
Figure 2:
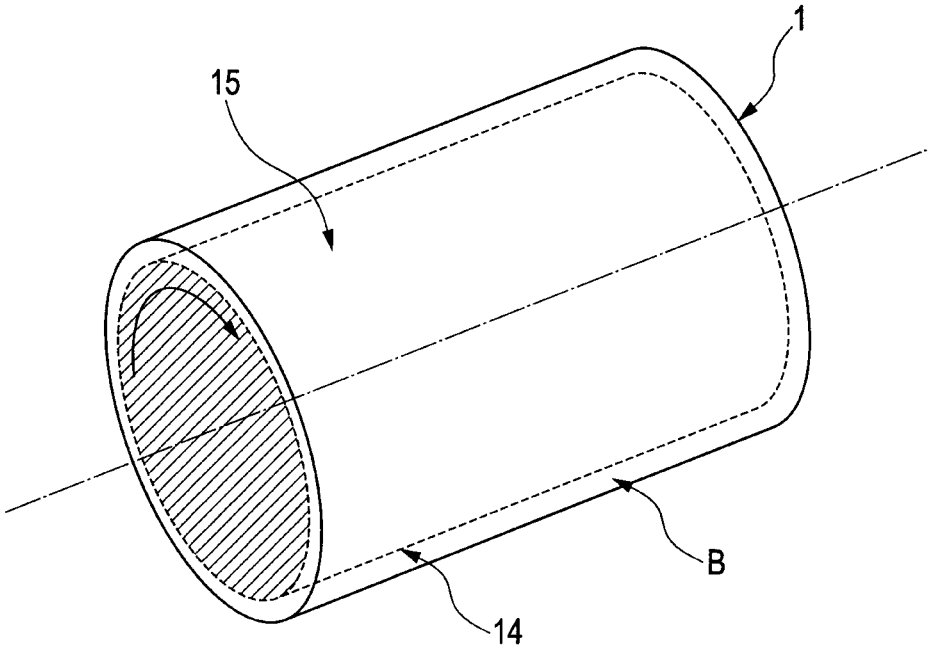
FIG. 2 is a schematic view illustrating the space volume of the minimum gap between the inner peripheral surface of the main body casing of the coating treatment apparatus and its stirring members.

A magnetic carrier of the present invention includes a magnetic carrier core and a resinous coating layer formed on a surface of the magnetic carrier core, and the resinous coating layer contains a resin composition and silica-alumina composite particles. The silica-alumina composite particles are a composite inorganic oxide in which silica and alumina are integrated with each other, and are particles in each of which both elements of Si and Al are observed by observation with a transmission electron microscope. An interface between silica and alumina may exist in each of the silica-alumina composite particles because the particles contain different metal oxides therein. In addition, dielectric property may be expressed by the occurrence of polarization at the interface between silica and alumina in each particle. It has been generally understood that the application of an electric field to the layers leads to the accumulation of charge between the layers in some cases when two layers different from each other in electric conductivity exist. In the present invention, the addition of the silica-alumina composite particles to the resinous coating layer of the magnetic carrier can impart the dielectric property to the magnetic carrier. As a result, the developing performance of the magnetic carrier is improved. Accordingly, the spending of toner or an external additive on the surface of the magnetic carrier is suppressed, and hence the charge-providing performance of the magnetic carrier can be maintained even when printing is performed on a large number of sheets. Further, the magnetic carrier can accumulate charge even under a high-temperature, high-humidity environment, and hence the occurrence of fogging after its standing can be suppressed.

It should be noted that hereinafter, alumina particles that do not contain silica therein are referred to as "alumina single particles," and silica particles that do not contain alumina therein are referred to as "silica single particles."

The silica-alumina composite particles preferably have a dielectric dissipation factor at 1,000 Hz of 0.02 or more and 1.00 or less. As long as the dielectric dissipation factor of the silica-alumina composite particles at 1,000 Hz is 0.02 or more and 1.00 or less, the interface between silica and alumina exists in a suitable state in each of the silica-alumina composite particles, and hence the silica-alumina composite particles may show high dielectric properties. As a result, a reduction in charge quantity after the particles have been subjected to endurance printing and then left to stand is alleviated, and hence the occurrence of fogging can be suppressed. It should be noted that it is difficult to produce silica-alumina composite particles having a dielectric dissipation factor at 1,000 Hz in excess of 1.00 because the silica-alumina composite particles are not a ferroelectric material. In addition, the reason why the frequency at which the dielectric dissipation factor is measured is set to 1,000 Hz is as described below. An AC voltage and a DC voltage are applied upon performance of development in a two-component development mode, and a frequency around 1,000 Hz is used for the AC voltage.

The content of alumina in the silica-alumina composite particles to be used in the present invention is preferably 5.0 mass % or more and 50.0 mass % or less. When the alumina content is 5.0 mass % or more, strong expression of the negative charging characteristic of silica is alleviated, and hence a change in the charge-providing performance of the magnetic carrier can be suppressed and charging tends to be stable. When the alumina content is 50.0 mass % or less, the particles obtain proper dielectric characteristics, and hence a reduction in charge quantity after their endurance standing is alleviated and the occurrence of fogging can be suppressed.

A crystallinity of alumina in the silica-alumina composite particles to be used in the present invention preferably be 1.0% or more and 60.0% or less. In addition, a crystallinity of alumina in the silica-alumina composite particles more preferably be 5.0% or more and 48.0% or less. When the crystallinity of alumina is 1.0% or more and 60.0% or less, an amorphous state exists at a proper ratio in each of the silica-alumina composite particles, and hence the interface between silica and alumina may be easily formed. In addition, the resistance of alumina does not become as high as that of silica, and hence there arises a difference in electric conductivity between alumina and silica. As a result, the silica-alumina composite particles have proper dielectric characteristics. Accordingly, a reduction in charge quantity after the particles have been subjected to endurance printing and then left to stand is alleviated, and hence the occurrence of fogging can be suppressed.

The dielectric properties of the silica-alumina composite particles to be used in the present invention may be expressed by interfacial polarization. In order that the silica-alumina composite particles may be caused to express good dielectric properties, the abundance of the silica single particles and the alumina single particles in the composite particles is more preferably made smaller than a specific value. To this end, the ratio of the alumina single particles and the silica single particles in the silica-alumina composite particles is preferably 8.5% or less, more preferably 4.5% or less.

The silica-alumina composite particles to be used in the present invention preferably have a volume resistivity of $1.0\times10^{5}$ Ω·m or more and $1.0\times10^{12}$ Ω·m or less.

When the silica-alumina composite particles have a volume resistivity of $1.0\times10^{5}$ Ω·m or more and $1.0\times10^{12}$ Ω·m or less, the particles are a composite inorganic oxide in which silica and alumina are moderately integrated with each other. As a result, the particles express good dielectric properties, a reduction in charge quantity after their standing after endurance printing is alleviated, and the occurrence of fogging can be suppressed. For information, when the volume resistivity is small, the amount of the alumina single particles in the silica-alumina composite particles tends to be large and/or the crystallinity of alumina tends to be low. In addition, when the volume resistivity is large, the amount of the silica single particles in the silica-alumina composite particles tends to be large and/or the crystallinity of alumina tends to be high. Further, the silica-alumina composite particles tend to be excessively coated by a surface treatment.

The silica-alumina composite particles to be used in the present invention have a BET specific surface area of preferably 10 $m^2/g$ or more and 200 $m^2/g$ or less, more preferably 20 $m^2/g$ or more and 150 $m^2/g$ or less. As long as the BET specific surface area of the silica-alumina composite particles is 10 $m^2/g$ or more and 200 $m^2/g$ or less, a proper amount of the silica-alumina composite particles can be added to the resinous coating layer of the magnetic carrier, and hence the ease with which the dielectric property of the magnetic carrier is expressed is improved.

In order that the ratio of the single particles in the silica-alumina composite particles may be set to a preferred one, in, for example, a gas phase method to be described later, a difference in rate between a reaction for producing silica from a silicon tetrachloride gas and a reaction for producing alumina from an aluminum trichloride gas needs to be adjusted. In other words, it is important to adjust a flow rate ratio between the silicon tetrachloride gas and the aluminum trichloride gas to be introduced into a combustion burner, and a method of flowing the gases into the burner, and it is also important to adjust a combustion time or temperature, a combustion atmosphere, and any other combustion condition.

Hereinafter, a method of producing the silica-alumina composite particles is described, provided that the silica-alumina composite particles to be used in the present invention can be produced by a known production method and their production method is not particularly limited.

Examples of the method of producing the silica-alumina composite particles include a method involving causing silica or alumina to adhere to the surface of an alumina particle or a silica particle, respectively in an aqueous medium to coat the particle, a doping method, and a gas phase method.

Of those, the gas phase method is preferred as the method of producing the silica-alumina composite particles to be used in the present invention.

Hereinafter, a method involving using a silicon tetrachloride gas and an aluminum trichloride gas is described as an example of the gas phase method. First, the silicon tetrachloride gas, an inert gas, hydrogen, and air are mixed so that a mixed gas may be prepared. Similarly, the aluminum trichloride gas, an inert gas, hydrogen, and air are mixed so that a mixed gas may be prepared. Those two kinds of mixed gases are mixed or separately introduced into a reaction chamber, and are then burned at a temperature of 1,000° C. or more and 2,500° C. or less so that the silica-alumina composite particles may be produced. After that, the produced silica-alumina composite particles are cooled and collected with a filter.

In the production method, a difference in rate between a reaction for producing silica from the silicon tetrachloride gas and a reaction for producing alumina from the aluminum trichloride gas needs to be adjusted (the reaction rate of the silica-producing reaction is higher than that of the alumina-producing reaction). In other words, it is important to adjust a flow rate ratio between the silicon tetrachloride gas and the aluminum trichloride gas to be introduced into a combustion burner, and a method of flowing the gases into the burner, and it is also important to adjust a combustion time or temperature, a combustion atmosphere, and any other combustion condition.

In addition, in order that the crystallinity of alumina in the silica-alumina composite particles may be set to a desired one, a post-step of heating the particles at a temperature of 80° C. or more and not more than 1,500° C., which is a temperature lower than the melting point of silica, is preferably performed. The inventors consider that through the adjustment of the condition of the post-step, the crystallinity of alumina in the silica-alumina composite particles can be controlled and hence a good dielectric characteristic may be obtained. A method for the post-step has only to be such that the temperature of the particles can be increased, and hence the method is not particularly limited. The method involves, for example, loading the particles into an electric furnace to treat the particles. For information, the crystallinity of alumina in the silica-alumina composite particles obtained without the performance of the post-step in the gas phase method is generally around 5%.

The silica-alumina composite particles may be subjected to a crushing treatment before a hydrophobic treatment, after the hydrophobic treatment, or simultaneously with the hydrophobic treatment as required. A known crushing machine can be used in the crushing treatment and is, for example, a high-speed impact fine pulverizer Pulverizer (manufactured by Hosokawa Micron Corporation).

In order that the characteristics of the silica-alumina composite particles to be used in the present invention may be caused, the particles are preferably subjected to no hydrophobic treatment. However, the silica-alumina composite particles may be subjected to a known hydrophobic treatment.

A method for the hydrophobic treatment is, for example, a method involving treating the silica-alumina composite particles with a hydrophobizing agent in a dry process, or a method involving immersing the silica-alumina composite particles in a solvent such as water or an organic compound and treating the particles with the hydrophobizing agent in a wet process.

Examples of the hydrophobizing agent include following: chlorosilanes such as methyl trichlorosilane, dimethyl dichlorosilane, trimethylchlorosilane, phenyl trichlorosilane, diphenyl dichlorosilane, t-butyl dimethylchlorosilane, and vinyl trichlorosilane; alcoxysilanes such as tetramethoxysilane, methyl trimethoxysilane, dimethyl dimethoxysilane, phenyl trimethoxysilane, diphenyl dimethoxysilane, o-methylphenyl trimethoxysilane, p-methylphenyl trimethoxysilane, n-butyl trimethoxysilane, i-butyl trimethoxysilane, hexyl trimethoxysilane, octyl trimethoxysilane, decyl trimethoxysilane, dodecyl trimethoxysilane, tetraethoxysilane, methyl triethoxysilane, dimethyl diethoxysilane, phenyl triethoxysilane, diphenyl diethoxysilane, i-butyl triethoxysilane, decyl triethoxysilane, vinyl triethoxysilane, γ-methacryloxypropyl trimethoxysilane, γ-glycydoxypropyl trimethoxysilane, γ-glycydoxypropylmethyl dimethoxysilane, γ-mercaptopropyl trimethoxysilane, γ-chloropropyl trimethoxysilane, γ-aminopropyl trimethoxysilane, γ-aminopropyl triethoxysilane, γ-(2-aminoethyl)aminopropyl trimethoxysilane, and γ-(2-aminoethyl)aminopropylmethyl dimethoxysilane; silazanes such as hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane, and dimethyltetravinyldisilazane; silicone oil such as dimethyl silicone oil, methyl hydrogen silicone oil, methylphenyl silicone oil, alkyl-modified silicone oil, chloroalkyl-modified silicone oil, chlorophenyl-modified silicone oil, fatty acid-modified silicone oil, polyether-modified silicone oil, alkoxy-modified silicone oil, carbinol-modified silicone oil, amino-modified silicone oil, fluorine-modified silicone oil, and terminal-reactive silicone oil; and siloxanes such as hexamethyl cyclotrisiloxane, octamethyl cyclotetrasiloxane, decamethyl cyclopentasiloxane, hexamethyl disiloxane, and octamethyl trisiloxane. Further, a fatty acid and a metal salt thereof can be used. Examples of long-chain fatty acids include undecylic acid, lauric acid, tridecylic acid, dodecylic acid, myristic acid, palmitic acid, pentadecylic acid, stearic acid, heptadecylic acid, arachic acid, montanoic acid, oleic acid, linoleic acid, and arachidonic acid, and examples of metal salts thereof include a zinc salt, an iron salt, a magnesium salt, an aluminum salt, a calcium salt, a sodium salt, and a lithium salt. Of those, alkoxysilanes, silazans, and straight silicone oil are preferred because the treatment is easy to perform. Those hydrophobizing agents may be used alone or in combination of two or more kinds thereof. When using two or more kinds of hydrophobizing agents, they can be used as a mixture or used in a surface treatment sequentially in steps.

Next, a resin for forming the resinous coating layer on the surface of the magnetic carrier core to be used in the present invention (hereinafter, sometimes referred to as "coating resin") is described.

A thermoplastic resin is preferably used as the coating resin. In addition, the coating resin may be one kind of resin, or may be a combination of two or more kinds of resins.

Examples of the thermoplastic resin include: polystyrene; an acrylic resin such as polymethyl methacrylate or a styrene-acrylate copolymer; a styrene-butadiene copolymer; an ethylene-vinyl acetate copolymer; polyvinyl chloride; polyvinyl acetate; a polyvinylidene fluoride resin; a fluorocarbon resin; a perfluorocarbon resin; a solvent-soluble perfluorocarbon resin; polyvinyl alcohol; polyvinyl acetal; polyvinyl pyrrolidone; a petrolium resin; cellulose; a cellulose derivative such as cellulose acetate, cellulose nitrate, methylcellulose, hydroxymethylcellulose, hydroxyethylcellulose, or hydroxypropylcellulose; a novolac resin; low molecular weight polyethylene; a polyester resin such as a saturated alkyl polyester resin, polyethylene terephthalate, polybutylene terephthalate, or polyarylate; a polyamide resin; a polyacetal resin; a polycarbonate resin; a polyether sulfone resin; a polysulfone resin; a polyphenylene sulfide resin; and a polyether ketone resin.

The tetrahydrofuran (THF) soluble matter of the coating resin preferably has a weight-average molecular weight Mw of 15,000 or more and 1,000,000 or less. As long as the Mw of the THF soluble matter of the coating resin falls within the range, adhesiveness between the magnetic carrier core and the resinous coating layer is good, and hence the surface of the magnetic carrier core can be coated in a nearly uniform state.

A method of producing the coating resin is, for example, a method involving directly obtaining particles through suspension polymerization, emulsion polymerization, or the like, or a method involving producing the particles through solution polymerization. Of those, the suspension polymerization or the emulsion polymerization method is preferably employed for producing the resin particles. In addition, their agglomeration is preferably prevented to the extent possible at the time of their dry-up. In addition, when an agglomerate is generated, a mechanical crushing treatment, or the removal of a coarse powder with a sieve or the like is preferably performed. In order that the average particle diameter of the resin particles may be controlled, the kind and amount of a dispersant or surfactant to be used in the polymerization are controlled.

A method for a coating treatment for forming the resinous coating layer on the surface of the magnetic carrier core from the coating resin is not particularly limited, and the treatment can be performed by a known method. For example, the so-called immersion method is available, which involves volatilizing a solvent while stirring the magnetic carrier core and a solution of the coating resin to coat the surface of the magnetic carrier core with the resin. An apparatus to be used in the method is, for example, a universal mixing stirring machine (manufactured by Fuji Paudal Co., Ltd.) or a Nauta Mixer (manufactured by Hosokawa Micron Corporation). Also available is a method involving spraying the resin solution from a spray nozzle while forming a fluidized bed to coat the surface of the magnetic carrier core with the resin. An apparatus to be used in the method is, for example, a Spiracoater (manufactured by OKADA SEIKO CO., LTD.) or a Spiraflow (manufactured by Freund Corporation). Also available is a method involving coating the surface of the magnetic carrier core with the resin by using the resin particles with the aid of a mechanical impact force in a dry process. An apparatus to be used in the method is an apparatus such as a HYBRIDIZER (manufactured by NARA MACHINERY CO., LTD.), a Mechanofusion (manufactured by Hosokawa Micron Corporation), or a HIGH FLEX GRAL (manufactured by Fukae Powtec).

In order that the silica-alumina composite particles may be effectively added to the resinous coating layer, a treatment for coating the surfaces of the magnetic carrier core particles with the resin particles and the silica-alumina composite particles is preferably performed by using a coating treatment apparatus having units for performing the coating treatment with the aid of a mechanical impact force.

An example of an apparatus used for the method for a coating treatment using a mechanical impact force as described above is described with reference to FIGS. 1 to 6.

The apparatus illustrated in FIG. 1 includes a rotation body 2 having a surface on which at least a plurality of stirring members 3 are disposed, a driving portion 8 for driving the rotation body 2 to rotate, and a main body casing 1 disposed with a gap from the stirring members 3. In addition, the apparatus illustrated in FIG. 1 includes a jacket 4 provided inside the main body casing 1 and on a rotation body end side surface 10 for allowing cooling and heating medium to flow. Further, in order to introduce an object to be treated, there is provided a raw material inlet 5 formed on the upper portion of the main body casing 1. Further, in order to discharge a magnetic carrier after the coating treatment from the main body casing 1, there is provided an outlet 6 formed at the lower portion of the main body casing 1. In addition, an inner piece for raw material inlet 16 is inserted in the raw material inlet 5, and an inner piece for outlet 17 is inserted in the magnetic carrier outlet 6.

The coating treatment of the magnetic carrier core particles using the apparatus illustrated in FIG. 1 is performed as described below. First, the inner piece for raw material inlet 16 is drawn from the raw material inlet 5, and the magnetic carrier core particles are fed from the raw material inlet 5. Next, resin particles are fed from the raw material inlet 5, and after that, the inner piece for raw material inlet 16 is inserted. It should be noted that a mixture of materials fed into the apparatus illustrated in FIG. 1 is referred to as the object to be treated.

Next, the rotation body 2 is rotated by the driving portion 8, and the object to be treated that is fed as described above is stirred and mixed by the plurality of stirring members 3 disposed on the surface of the rotation body 2 for performing the coating treatment.

It should be noted that as an order of feeding raw materials from the raw material inlet 5, it is possible to feed the resin composition particles first, and then to feed the magnetic carrier core particles. In addition, it is possible to mix the magnetic carrier core particles and the resin composition particles in advance using a mixer such as a HENSCHEL mixer, and then feed the mixture.

After the coating treatment, the inner piece for outlet 17 in the outlet 6 is drawn, the rotation body 2 is rotated by the driving portion 8, and the magnetic carrier is ejected from the magnetic carrier outlet 6. The resultant magnetic carrier is subjected to magnetic separation, and then residual resin composition particles are separated with a sieve such as a circular vibrating sieve as required. Thus, a magnetic carrier is obtained.

It should be noted that a procedure of the above-mentioned coating treatment is a batch type, but the coating treatment may be a continuous type that is performed in a state in which an inner piece for raw material inlet 16 and an inner piece for outlet 17 are drawn from beginning. When the continuous type coating treatment is performed, the rotation body 2 is rotated by the driving portion 8 in a state in which the inner piece for raw material inlet 16 and the inner piece for outlet 17 are drawn from beginning. Next, the object to be treated is fed from the raw material inlet 5, and the magnetic carrier as a product is collected from the outlet 6.

Figure 3:
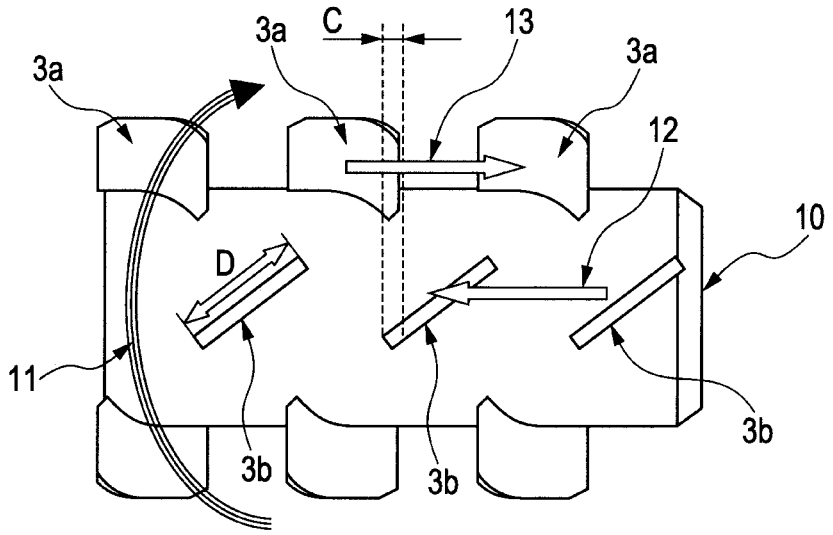
FIG. 3 is a schematic view illustrating an example of the stirring members of the coating treatment apparatus.

In the apparatus illustrated in FIG. 1, when the coating treatment is performed, the rotation body 2 rotates in a counterclockwise direction 11 viewed from the direction of the driving portion 8 as illustrated in FIG. 3. In this case, three stirring members 3*b* on the middle of the rotation body 2 move to positions of the three stirring members 3*a* on the upper portion of the rotation body 2 perpendicularly to a center shaft 7. In this case, the object to be treated that is fed from the raw material inlet 5 is moved by the stirring members 3*b* in a direction (12) from the rotation body end side surface 10 to the driving portion 8, and is moved by the stirring members 3*a* in a direction (13) from the driving portion 8 to the rotation body end side surface 10.

Figure 4:
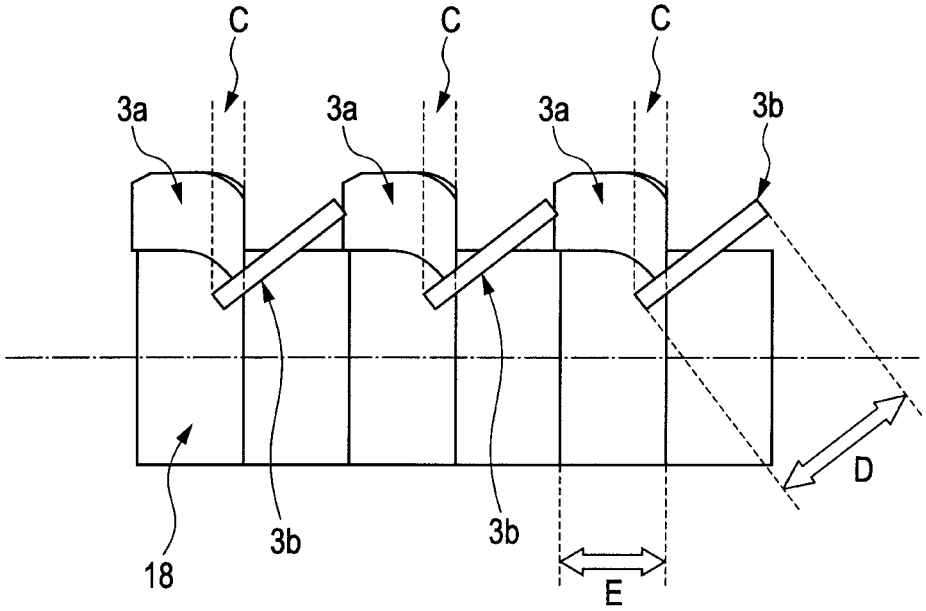
FIG. 4 is a schematic view illustrating a relationship between the respective stirring members of the coating treatment apparatus.

Further, as illustrated in FIG. 4, the stirring members 3*a* on the upper portion of the rotation body and the stirring members 3*b* on the middle of the rotation body have such positional relationship that the stirring members 3*a* and the stirring members 3*b* are overlapped with each other by a width C when the stirring members 3*a* and the stirring members 3*b* are directly overlapped, namely when a line is drawn from an end position of the stirring members 3*a* in a direction perpendicular to the rotation center. It should be noted that FIG. 4 illustrates the stirring members 3*a* and the stirring members 3*b* in an overlapped state for convenience sake to explain the width C, and the coating treatment is not performed in this state. Similarly in FIG. 5, the stirring members 3*a* and the stirring members 3*b* are overlapped for convenience sake to explain the width C in a case where a shape of the stirring members 3 is different from FIGS. 3 and 4, and the coating treatment is not performed in this state.

Figure 5:
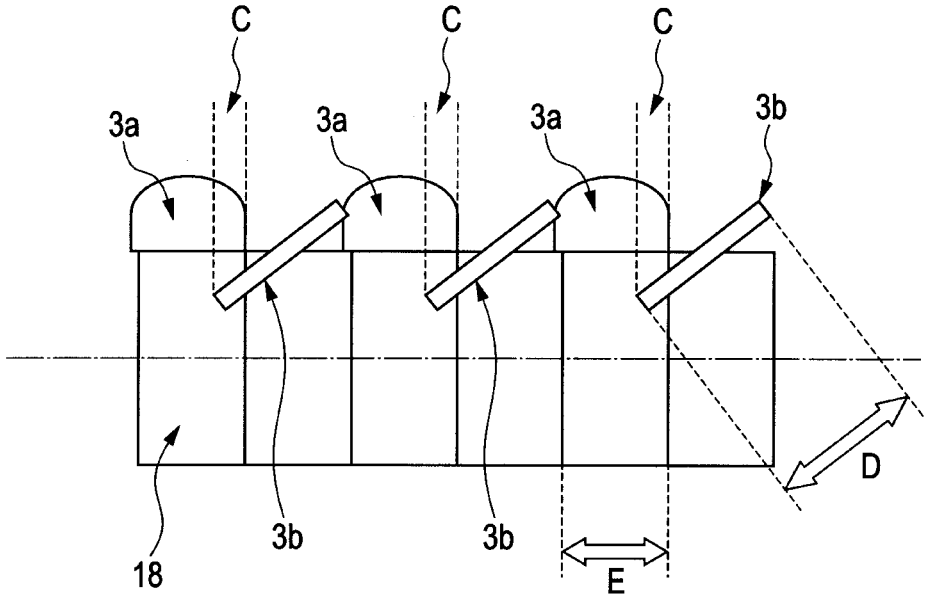
FIG. 5 is a schematic view illustrating a relationship between the respective stirring members of the coating treatment apparatus.
Figure 6:
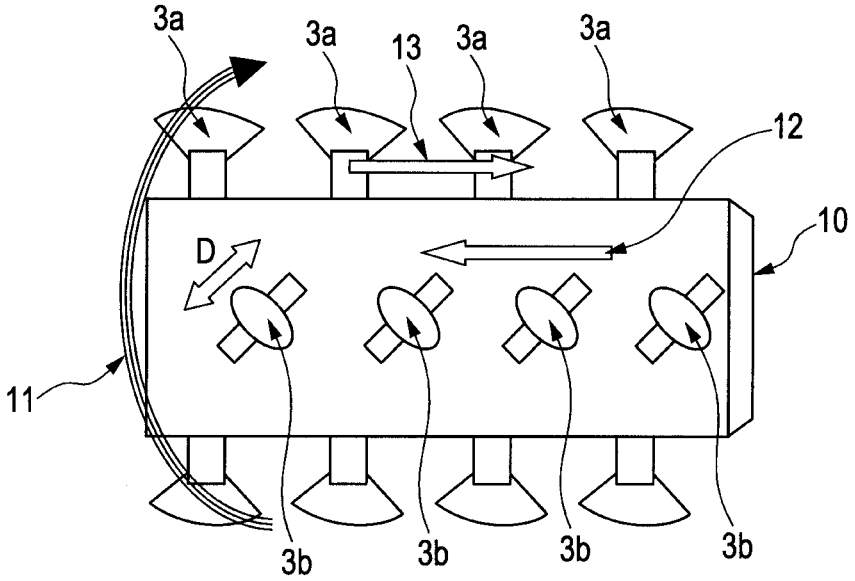
FIG. 6 is a schematic view illustrating a second mode of the stirring members of the coating treatment apparatus.

A shape of the stirring members 3 may be any one of rectangular, circular-tipped, or paddle-tipped shapes as illustrated schematically in FIGS. 3, 5 and 6. It is important to set an appropriate relationship between the overlapping width C and a maximum width D of the stirring members 3, as described later.

The object to be treated that is moved by the stirring members 3*b* in the direction (12) from the rotation body end side surface 10 to the driving portion 8 collides with the object to be treated that is moved by the stirring members 3*a* in the direction (13) from the driving portion 8 to the rotation body end side surface 10. In other words, moving in the direction (12) from the rotation body end side surface 10 to the driving portion 8 and moving in the direction (13) from the driving portion 8 to the rotation body end side surface 10 are performed repeatedly for the object to be treated by rotation of the rotation body 2. Further, when the collision between the magnetic carrier core particles and the resin composition particles is performed repeatedly, a moving path of the object to be treated in the main body casing 1 becomes complicated and a long distance so that the object to be treated is mixed uniformly.

When the apparatus is used, the 50% particle diameter (D50) on a volume basis of the resin particles is preferably set to 0.2 μm or more and 6.0 μm or less, and the ratio of particles each having a particle diameter of 10.0 μm or more is preferably set to 2.0 vol % or less.

In addition, in order that the coalescence of the particles of the magnetic carrier may be obviated and the occurrence of residual resin particles may be prevented, the temperature (T(° C.)) of the object to be treated in the coating treatment is preferably controlled within a range satisfying the following formula:

$$Tg-50 \leq T \leq Tg+20$$

(Tg: the glass transition temperature (° C.) of the resin particles).

Further, for example, the following methods are each available as a method of adding the silica-alumina composite particles with the apparatus: a method involving coating the magnetic carrier core particles with both the silica-alumina composite particles and the resin particles; a method involving coating the magnetic carrier core particles with the silica-alumina composite particles and the resin particles, and further coating the resultant particles with the resin particles; and a method involving implanting the silica-alumina composite particles alone in the magnetic carrier coated with the resin. It should be noted that the silica-alumina composite particles are more preferably caused to exist near the magnetic carrier core in order that the dielectric characteristics of the silica-alumina composite particles may be sufficiently caused.

In the coating treatment, the resin particles are used at a ratio of preferably 0.1 mass % or more and 7.0 mass % or less, more preferably 0.5 mass % or more and 5.0 mass % or less with respect to 100 parts by mass of the magnetic carrier core particles. In addition, the number of times of the coating treatment with the resin particles is preferably twice or more, more preferably twice in terms of cost.

The magnetic carrier has a 50% particle diameter (D50) on a volume basis in the range of preferably 20.0 μm or more and 100.0 μm or less, more preferably 25.0 μm or more and 60.0 μm or less. When the 50% particle diameter (D50) on a volume basis of the magnetic carrier falls within the range of 20.0 μm or more and 100.0 μm or less, the density of magnetic brushes at a developing pole is optimized. In addition, the charge quantity distribution of toner becomes sharp, thereby enabling an improvement in the quality of a halftone image.

The magnetic carrier preferably has a specific resistance in 1,000 V/cm of $1.0\times10^{8}$ Ω·cm or more and $1.0\times10^{12}$ Ω·cm or less. As long as the specific resistance of the magnetic carrier in 1,000 V/cm falls within the range, an image density becomes sufficient, and detrimental effects such as a blank dot and fogging can be suppressed.

In addition, the 50% particle diameter (D50) on a volume basis of the magnetic carrier core particles falls within the range of preferably 19.5 μm or more and 99.5 μm or less, more preferably 24.5 μm or more and 59.5 μm or less.

In addition, when the 50% particle diameter (D50) on a volume basis of the resin particles is represented by Db (μm) and the 50% particle diameter (D50) on a volume basis of the magnetic carrier core particles is represented by Dc (μm), their relationship is preferably such that a ratio Db/Dc is 0.002 or more and 0.310 or less.

Next, the magnetic carrier core particles are described.

Examples of the magnetic carrier core particles include magnetic ferrite particles containing one or two or more kinds of elements selected from iron, lithium, beryllium, magnesium, calcium, rubidium, strontium, nickel, cobalt, manganese, and titanium. Other examples are magnetite particles and magnetic material-dispersed resin carrier core particles. Of those, magnetite particles, and ferrite particles at least containing one or two or more kinds of elements selected from manganese, calcium, lithium, and magnesium are preferred.

Examples of the ferrite particles include particles of iron-based oxides such as Ca—Mg—Fe-based ferrite, Li—Fe-based ferrite, Mn—Mg—Fe-based ferrite, Ca—Be—Fe-based ferrite, Mn—Mg—Sr—Fe-based ferrite, Li—Mg—Fe-based ferrite, Li—Ca—Mg—Fe-based ferrite, and Li—Mn—Fe-based ferrite.

A method of producing the ferrite particles is as described below. The oxides, carbonates, or nitrates of the respective metals are mixed in a wet process or a dry process, and then the mixture is calcined so as to have desired ferrite composition. Next, the resultant ferrite particles are pulverized so as to have particle diameters of submicrons. In order that the particle diameter of the magnetic carrier core may be adjusted, water is added at a ratio of 20 mass % or more and 50 mass % or less to the pulverized ferrite particles. Then, a binder resin such as a polyvinyl alcohol (having a molecular weight of 500 or more and 10,000 or less) is added at a ratio of 0.1 mass % or more and 10 mass % or less so that slurry may be prepared. The slurry is granulated with a spray dryer or the like, and is then calcined. Thus, a ferrite core can be obtained.

A magnetic material-dispersed resin carrier core obtained by polymerizing a monomer for forming a binder resin in the presence of a magnetic material can also be used as the magnetic carrier core. Here, examples of the monomer for forming a binder resin include the following monomers.

A vinyl-based monomer; bisphenols and epichlorohydrin for forming an epoxy resin; phenols and aldehydes for forming a phenol resin; urea and aldehydes for forming a urea resin; and melamine and aldehydes.

A phenol resin polymerized from phenols and aldehydes is preferably used as the binder resin of the magnetic material-dispersed resin carrier core. In this case, the magnetic material-dispersed resin carrier core can be produced by: adding the magnetic material, the phenols, and the aldehydes to an aqueous medium; and polymerizing the phenols and the aldehydes in the aqueous medium in the presence of a basic catalyst.

In addition, examples of the magnetic material to be used in the magnetic material-dispersed resin carrier core include magnetite particle and ferrite particle. The magnetic material preferably has a particle diameter of 0.02 μm or more and 2.00 μm or less.

The magnetic carrier core particles have a specific resistance in 300 V/cm of preferably $1.0\times10^{6}$ Ω·cm or more and $5.0\times10^{10}$ Ω·cm or less, more preferably $3.0\times10^{6}$ Ω·cm or more and $1.0\times10^{8}$ Ω·cm or less. When the specific resistance of the magnetic carrier core particles falls within the above-mentioned range, dielectric characteristics of the added silica-alumina composite particles easily develop. In other words, the inventor believes that as the resistance of the magnetic carrier core particles becomes lower, a charge-retaining effect becomes stronger because the electric field intensity when toner is developed is applied to the silica-alumina composite particles. As a result, developing performance and standing characteristics are improved.

Next, the toner is described. As the toner, it is possible to use toner manufactured by a known method such as a crushing method, a polymerization method, an emulsion aggregation method, and a dissolution suspension method.

As constituent material of the toner particles containing a binder resin, a wax, and a colorant, it is possible to use various conventional toner materials. As the binder resin of the toner, it is possible to use a resin that is usually used for toner.

Of the physical properties of the toner, one resulting from the binder resin is a molecular weight distribution measured by the gel permeation chromatography (GPC) of its tetrahydrofuran (THF) soluble matter. More preferred is the case where in the molecular weight distribution, the toner has at least one peak in a molecular weight region of 2,000 or more and 50,000 or less, and a component having a molecular weight of 1,000 or more and 30,000 or less exists at a content of 50% or more and 90% or less.

In addition, the wax is preferably used in terms of an improvement in releasability from a fixing member at the time of fixation and an improvement in fixing performance. Further, a charge control agent is preferably internally or externally added to toner particles for controlling the charge quantities and charge quantity distribution of the toner particles.

Alternatively, an external additive as fine particles may be externally added to the toner. The external addition of the fine particles can improve its flowability and transferability.

The external additive preferably contains any of the following fine particles: titanium oxide (BET specific surface area=80 $m^2/g$), aluminum oxide, and silica fine particles. In addition, the external additive has a specific surface area according to nitrogen adsorption measured by a BET method of preferably 20 $m^2/g$ or more, more preferably 50 $m^2/g$ or more.

Fine particles having a number-average particle diameter of 80 nm or more and 300 nm or less are preferably used as the external additive. The reason for the foregoing is that an adhesive force between the toner and the carrier can be reduced, and hence efficient development can be performed even when the toner has a high charge quantity. A material for the external additive is, for example, silica, alumina, titanium oxide, or cerium oxide. In the case of silica, silica produced by employing a conventionally known technology such as a vapor-phase decomposition method, a combustion method, or a deflagration method can be used. Silica particles obtained by a sol-gel method out of such technologies are preferably used because their particle size distribution can be made sharp.

The content of the external additive is preferably 0.1 part by mass or more and 5.0 parts by mass or less, more preferably 0.5 part by mass or more and 4.0 parts by mass or less with respect to 100 parts by mass of the toner particles. In addition, the external additive may be a combination of multiple kinds of fine particles.

When a two-component developer is prepared by mixing the magnetic carrier and the toner, the concentration of the toner in the developer is preferably 2 mass % or more and 15 mass % or less, more preferably 4 mass % or more and 13 mass % or less.

Next, a measuring method is described.

(Measuring Method for Crystallinity of Alumina of Silica-Alumina Composite Particles)

The crystallinity of alumina of the silica-alumina composite particles was measured with a powder X-ray diffraction apparatus as described below.

As the powder X-ray diffraction apparatus, it is possible to use a horizontal sample type strong X-ray diffraction apparatus "RINT.TTR2" manufactured by Rigaku Corporation (with an X-ray source of CuKα rays (λ=0.15418 nm)). Specific measurement of the X-ray diffraction is performed as described below.

A sample to be measured is placed in a powder state on a reflection free sample holder (manufactured by Rigaku Corporation) having no diffraction peak within a measurement range. In this case, the sample is lightly pressed to be flat while it is placed on the reflection free sample holder. When the sample is pressed too strongly, the crystals may be oriented so that a correct area ratio is not calculated. When the sample becomes flat, the sample holder with the sample is set to the apparatus.

<<Measurement Conditions>>

Bulb: Cu
Parallel beam optics
Voltage: 50 kV
Current: 300 mA
Start angle: 10°
End angle: 40°
Sampling width: 0.02°
Scanning speed: 4.00°/min
Divergence slit: open
Divergence vertical slit: 10 mm
Scattering slit: open
Light reception slit: open The crystallinity was calculated as described below with analyzing software "JADE6" attached to the above-mentioned apparatus based on a peak obtained by the measurement.

(1) An AEROSIL (registered trademark) 130 (fumed silica particles manufactured by Nippon Aerosil Co., Ltd.) and an MT-150W (titania particles manufactured by TAYCA CORPORATION) are used. Multiple samples having different silica contents are produced by mixing those materials, and then each of these samples is subjected to X-ray diffraction measurement. Then, a calibration curve between the area of the resultant broad peak derived from the amorphous state of silica having a peak top at a diffraction angle (2θ±0.5°) of 21.0° to 25.0° and the silica content is created. It should be noted that in the examples of the present application, mixing ratios between the AEROSIL 130 and the MT-150W were set to 100.0:0.0, 80.0:20.0, 60.0:40.0, 40.0:60.0, 20.0:80.0, and 0.0:100.0 in terms of a mass ratio, and each sample was subjected to the measurement.

The reason why the MT-150W (titania particles manufactured by TAYCA CORPORATION) was used is as described below. The MT-150W has a rutile type crystal and has a crystalline peak at a diffraction angle (2θ±0.5°) of 27.4°, and hence the peak does not overlap the peak derived from the amorphous state of silica. Accordingly, the MT-150W is suitable for the creation of the calibration curve between the area of the broad peak derived from the amorphous state of silica and the silica content.

(2) The silica-alumina composite particles are subjected to X-ray diffraction measurement. Then, a peak area A of a broad peak obtained by the X-ray diffraction derived from the amorphous states of silica and alumina having a peak top at a diffraction angle (2θ±0.5°) of 21.0° to 25.0° is calculated.

In addition, a sum B of the peak areas of a peak derived from the γ crystal of alumina having a peak top at a diffraction angle (2θ±0.5°) of 46.0°, and a peak derived from a mullite crystal formed of alumina and silica having a peak top at a diffraction angle (2θ±0.5°) of 26.1° is calculated.

(3) The crystallinity is calculated from the following calculation equation.

$$\text{Crystallinity}(\%)=B/((A-C)+B\times 100$$

C in the equation represents the peak area of a peak derived from the amorphous state of silica having a peak top at a diffraction angle)(2θ±0.5°) of 21.0° to 25.0° calculated from the silica content of the silica-alumina composite particles on the basis of the calibration curve obtained in the section (1).

(Method of Measuring Content of Alumina in Silica-Alumina Composite Particles)

The content of alumina in the silica-alumina composite particles is measured by performing fluorescent X-ray analysis with a fluorescent X-ray analyzer SYSTEM 3080 (manufactured by Rigaku Denki Kogyo Co., Ltd.) in accordance with JIS K0119 "General rules for fluorescent X-ray analysis."

(Detection of Silica-Alumina Composite Particles, and Measurement of Abundance Ratio of Silica Single Particles and Alumina Single Particles)

The abundance ratio of the silica single particles and the alumina single particles can be grasped by observation with a transmission electron microscope (TEM-EDX). Specifically, in the observation with the transmission electron microscope (TEM-EDX), the particles to be observed are subjected to element mapping for elements of interest under a magnification of, for example, 100,000 or more and 200,000 or less. Then, with regard to the element mapping for Si and Al, particles in each of which both elements of Si and Al are observed are defined as silica-alumina composite particles, and particles in each of which only one of the elements is observed are defined as single particles. The observation is performed on 1,000 particles, and then the abundance ratio (number %) of the single particles is calculated.

(Method of Measuring Volume Resistivity of Silica-Alumina Composite Particles)

Figure 7:
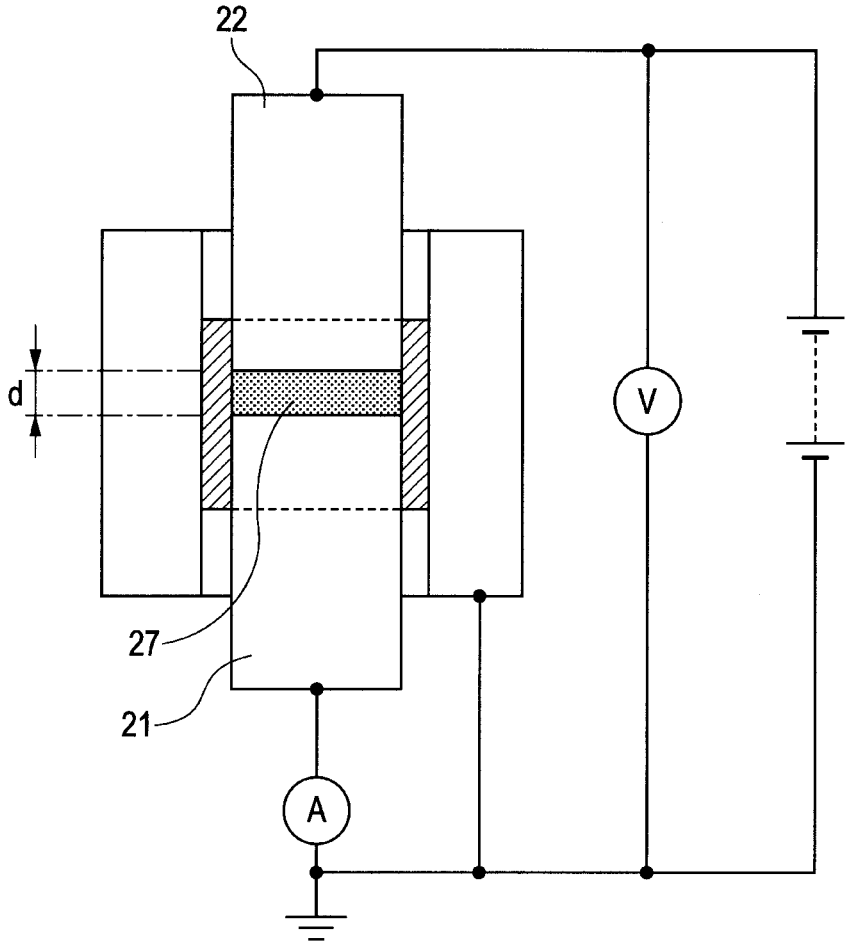
FIG. 7 illustrates an example of an apparatus for measuring a volume resistivity.

FIG. 7 illustrates an apparatus for measuring the volume resistivity of the silica-alumina composite particles. The following method is employed. Silica-alumina composite particles 27 are loaded into the measuring apparatus, electrodes 21 and 22 are placed so as to contact the silica-alumina composite particles, a voltage is applied between the electrodes, a current flowing at the time is measured, and their volume resistivity is determined from their specific resistance. In the measuring method, attention needs to be paid because of the following reason. As the silica-alumina composite particles are powder, their filling factor changes and the volume resistivity changes in association with the change in some cases. Conditions for measuring the volume resistivity are as described below. An area S of contact between the silica-alumina composite particles and each of the electrodes is set to about 2.3 $cm^2$, a thickness d of the sample is set to 1.0 mm or more and 1.5 mm or less, and the load of the upper electrode 22 is set to 180 g (1.76 N). In addition, the applied voltage is increased in an increment of 200 V at an interval of 30 seconds, and the specific resistance measured at the time of the application of a voltage of 1,000 V is defined as the volume resistivity.

(Method of Measuring BET Specific Surface Area)

The measurement of a BET specific surface area is performed in conformity with JIS Z8830 (2001). A specific measuring method is as described below.

An "automatic specific surface area/pore size distribution-measuring apparatus TriStar 3000 (manufactured by Shimadzu Corporation)" adopting a gas adsorption method based on a constant-volume method as a measuring mode is used as a measuring apparatus. The setting of measurement conditions and the analysis of measurement data are performed with a dedicated software "TriStar 3000 Version 4.00" included with the apparatus. In addition, a vacuum pump, a nitrogen gas piping, and a helium gas piping are connected to the apparatus. A nitrogen gas is used as an adsorption gas, and a value calculated by a BET multipoint method is defined as the BET specific surface area.

It should be noted that the BET specific surface area is calculated as described below.

First, a sample is caused to adsorb the nitrogen gas, and then an equilibrium pressure P (Pa) in a sample cell and a nitrogen adsorption Va ($mol \cdot g^{-1}$) of the sample at the time are measured. Then, an adsorption isotherm is created, whose axis of abscissa indicates a relative pressure Pr as a value obtained by dividing the equilibrium pressure P (Pa) in the sample cell by a saturated vapor pressure Po (Pa) of nitrogen, and whose axis of ordinate indicates the nitrogen adsorption Va ($mol \cdot g^{-1}$). Next, a monomolecular layer adsorption Vm ($mol \cdot g^{-1}$) as an adsorption needed for the formation of a monomolecular layer on the surface of the sample is determined by applying the following BET equation:

$$Pr/Va(1-Pr)=1/(Vm\times C)+(C-1)\times Pr/(Vm\times C)$$

(where C represents a BET parameter, which is a variable that fluctuates depending on the kind of the measurement sample, the kind of the adsorption gas, and an adsorption temperature).

The BET equation can be interpreted as a straight line having a gradient of (C−1)/(Vm×C) and an intercept of 1/(Vm×C) when the X-axis indicates Pr and the Y-axis indicates Pr/Va(1−Pr) (the straight line is referred to as "BET plot").

$$\text{Gradient of straight line}=(C-1)/(Vm\times C)$$

$$\text{Intercept of straight line}=1/(Vm\times C)$$

When actual values for Pr and actual values for Pr/Va(1−Pr) are plotted on a graph, and then a straight line is drawn on the basis of a least-squares method, values for the gradient and intercept of the straight line can be calculated. Vm and C can be calculated by solving the simultaneous equations for the gradient and the intercept with those values.

Further, a BET specific surface area S ($m^2 \cdot g^{-1}$) of the sample is calculated from Vm calculated in the foregoing and the molecule-occupied sectional area (0.162 $nm^2$) of a nitrogen molecule on the basis of the following equation:

$$S=Vm\times N\times 0.162\times 10^{-18}$$

(where N represents Avogadro's constant ($mol^{-1}$)).

The measurement with the apparatus follows a "TriStar 3000 Operator's Manual V 4.0" included with the apparatus.

<Measurement of Glass Transition Point (Tg) of Resin Particles>

The glass transition point (Tg) of the resin particles is measured with a differential scanning calorimeter "Q1000" (manufactured by TA Instruments) in conformity with ASTM D3418-82. Temperature correction for the detecting portion of the apparatus is performed with the melting points of indium and zinc, and heat quantity correction therefor is performed with the heat of fusion of indium. Specifically, about 10 mg of the resin particles are precisely weighed and loaded into an aluminum pan, and then the measurement is performed in the measuring range of 30 to 200° C. at a rate of temperature increase of 10° C./min with an empty aluminum pan as a reference. A change in specific heat is obtained in the temperature range of 40° C. to 100° C. in the temperature increase process. A point of intersection of a line passing the middle point of a baseline before and after the appearance of the change in specific heat, and a differential thermal curve at this time is defined as the glass transition temperature Tg of the resin particles.

<Method of Measuring 50% Particle Diameter (D50) on Volume Distribution Basis of Each of Magnetic Carrier Core, Resin Particles, and Magnetic Carrier>

Particle size distribution measurement is performed with a particle size distribution-measuring apparatus "Microtrac MT3300EX" (manufactured by NIKKISO CO., LTD.) according to a laser diffraction/scattering mode mounted with a sample-supplying machine "one-shot dry type sample conditioner Turbotrac" (manufactured by NIKKISO CO., LTD.) for dry measurement.

Conditions under which the Turbotrac supplies a sample are as described below. A dust collector is used as a vacuum source, its airflow rate and pressure are set to 33 l/sec and 17 kPa, respectively, and the control of the machine is automatically performed on software. A 50% particle diameter (D50) as an accumulated value on a volume basis is determined, and further, the content of particles each having a particle diameter of 10.0 μm or more is determined. The control and the analysis are performed with the software (version 10.3.3-202D) included with the machine. Measurement conditions are as follows: a SetZero time of 10 seconds, a measuring time of 10 seconds, and the number of times of measurement of once. The refractive index of a particle is regarded as 1.81, the shape of the particle is regarded as a nonspherical shape, and a measurement upper limit and a measurement lower limit are set to 1,408 μm and 0.243 μm, respectively. The measurement is performed under a normal-temperature, normal-humidity (23° C., 50% RH) environment.

<Measurement of Molecular Weight of Resin Particles>

The molecular weight distribution of the tetrahydrofuran (THF) soluble matter of the resin particles is measured by gel permeation chromatography (GPC) as described below. First, the resin particles are dissolved in tetrahydrofuran (THF) at 23° C. over 24 hours. Then, the resultant solution is filtered with a solvent-resistant membrane filter "Myshori Disk" (manufactured by TOSOH CORPORATION) having a pore diameter of 0.2 μm so that a sample solution may be obtained. It should be noted that the concentration of a component soluble in THF in the sample solution is adjusted to 0.8 mass %. Measurement is performed with the sample solution under the following conditions.

Apparatus: HLC 8120 GPC (detector: RI) (manufactured by TOSOH CORPORATION)

Column: set of seven columns consisting of Shodex KF-801, 802, 803, 804, 805, 806, and 807 (Manufactured by Showa Denko KK)

Eluent: tetrahydrofuran (THF)

Flow velocity: 1.0 ml/min

Oven temperature: 40.0° C.

Sample injection amount: 0.10 ml

When the molecular weight of the sample is calculated, a molecular weight calibration curve is used, which is created by using a standard polystyrene resin. As the standard polystyrene resin, there are given, for example, the following materials. Specifically, there are TSK standard polystyrenes F-850, F-450, F-288, F-128, F-80, F-40, F-20, F-10, F-4, F-2, F-1, A-5000, A-2500, A-1000, and A-500 (manufactured by Tosoh Corporation).

<Measuring Method of Dielectric Dissipation Factor>

Using a 4284A precision LCR meter (manufactured by Hewlett-Packard Company), the calibration is performed at a frequency of 1,000 Hz.

The sample molding for the measurement is performed as described below. First, the sample of approximately 2.5 g is weighed, and a load of 34,300 kPa (350 $kgf/cm^2$) is applied to the sample for 2 minutes so that the sample is molded into a disc shape having a diameter of 25 mm and a thickness of approximately 1 mm to be a measurement sample.

This measurement sample is attached and fixed to ARES (manufactured by TA Instruments) with a dielectric constant measuring jig (electrode) having a diameter of 25 mm. After that, a precise thickness of the molded sample to which a load of 0.98 N (100 g) is applied is input, and the measurement is performed at normal temperature (23° C.)

<Measurement of Specific Resistance of Magnetic Carrier and Magnetic Carrier Core>

Figure 8A:
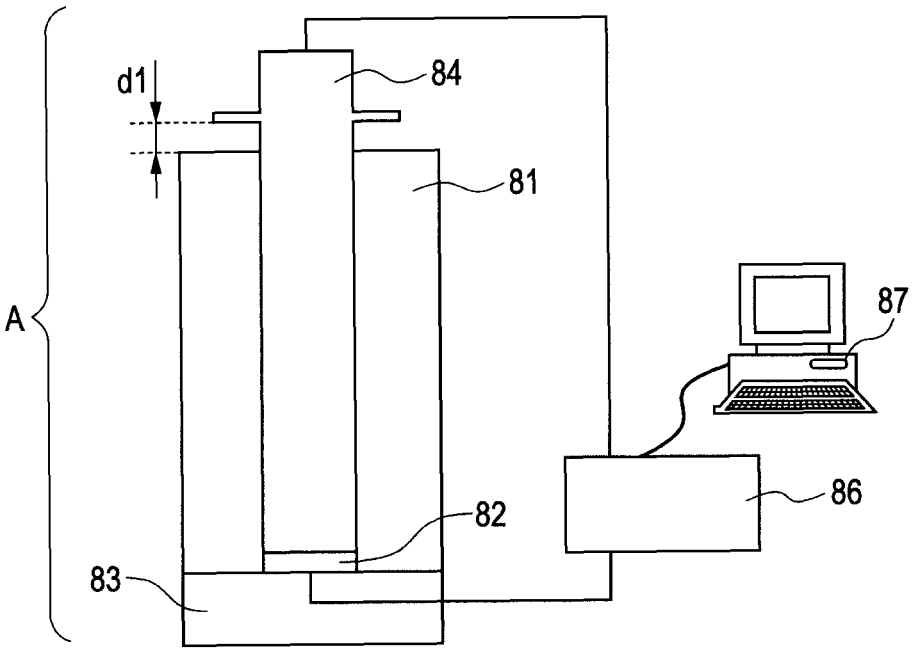
FIG. 8A is a schematic sectional view of an apparatus for measuring the specific resistance of a magnetic carrier, a magnetic core, or the like, the figure illustrating a blank state before the loading of a sample.
Figure 8B:
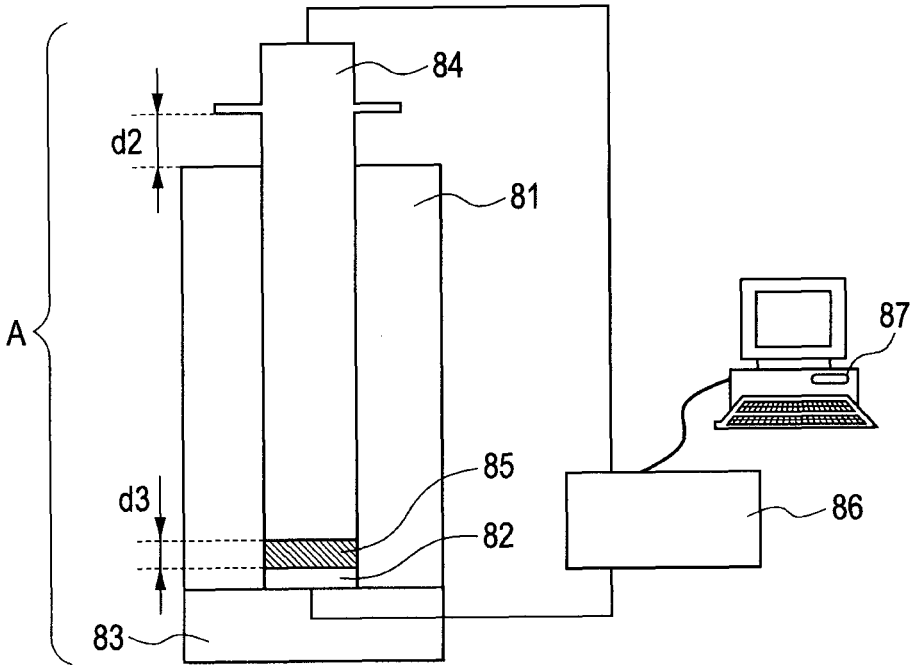
FIG. 8B is a schematic sectional view of the apparatus for measuring the specific resistance of a magnetic carrier, a magnetic core, or the like, the figure illustrating a state when the sample is loaded.

Specific resistance values of the magnetic carrier and the magnetic carrier core are measured using a measurement apparatus illustrated schematically in FIGS. 8A and 8B.

A resistance measurement cell A includes a cylindrical PTFE resin container 81 with a hole having a cross-sectional area of 2.4 $cm^2$, a lower electrode (made of stainless steel) 82, a support table (made of PTFE resin) 83, and an upper electrode (made of stainless steel) 84. The cylindrical PTFE resin container 81 is placed on the support table 83, and a sample 85 (magnetic carrier or magnetic carrier core) is put in the cylindrical PTFE resin container 81 in a range of approximately 0.5 g to 1.3 g. Then, the upper electrode 84 is placed on the sample 85 so as to measure a thickness of the sample. It is supposed that a thickness without the sample measured in advance is d1 (blank), and that a thickness with the sample is d2 (sample). Then, the actual thickness d3 of the sample can be expressed by the following equation.

$$d3=d2(\text{sample})-d1(\text{blank})$$

In this case, it is important to appropriately change the amount of the sample so that the thickness of the sample becomes 0.95 mm or more and 1.04 mm or less.

A voltage is applied between the electrodes, and the flowing current at the time is measured so that specific resistance values of the magnetic carrier and the magnetic carrier core can be determined. The measurement is performed using an electrometer 86 (Keithley 6517A manufactured by Keithley Instruments, Inc.), and a computer 87 for controlling.

As the controlling computer, a control system manufactured by National Instruments Corporation and control software (LabVEIW manufactured by National Instruments Corporation) are used. As measurement conditions, a contact area of 2.4 $cm^2$ between the sample and the electrode, and the actual thickness d3 of the sample are input. In addition, the load to the upper electrode is set to 120 g, and a maximum applied voltage is set to 1,000 V.

As a condition for applying the voltage, the IEEE-488 interface is used for control between the controlling computer and the electrometer. Then, using an automatic range function of the electrometer, voltages of 1 V, 2 V, 4 V, 8 V, 16 V, 32 V, 64 V, 128 V, 256 V, 512 V, and 1,000 V are applied for 1 second each for performing screening. In this case, the electrometer judges whether or not voltages up to 1,000 V (approximately 10,000 V/cm as electric field intensity) can be applied. When an overcurrent flows, "VOLTAGE SOURCE OPERATE" blinks. Then, the applied voltage is decreased, and voltages that can be applied are further screened so that a maximum value of the applied voltage is automatically determined. After that, the main measurement is performed. The maximum voltage is divided by five, and the obtained voltage is used as a step. From a current value after maintaining for 30 seconds, the resistance value is measured. For instance, when the maximum applied voltage is 1,000 V, the voltage is applied while increasing and decreasing by a step of 200 V, in order of 200 V, 400 V, 600 V, 800 V, 1,000 V, 1,000 V, 800 V, 600 V, 400 V, and 200 V. In each step, the resistance value is measured from a current value after maintaining for 30 seconds.

It should be noted that the specific resistance and the electric field intensity are determined by the following equations.

$$\text{specific resistance}(\Omega\cdot\text{cm})=(\text{applied voltage(V)}/\text{measurement current(A)})\times S(\text{cm}^2)/d(\text{cm})$$

$$\text{electric field intensity(V/cm)}=\text{applied voltage(V)}/d(\text{cm})$$

EXAMPLES

Production Example of Silica-Alumina Composite Particles 1

An aqueous solution of aluminum trichloride (flow rate: 0.137 kg/h) brought into an aerosol state through ultrasonic atomization, silicon tetrachloride (flow rate: 0.415 kg/h) evaporated at 200° C., and nitrogen were uniformly mixed, and then the mixture was atomized into an oxygen-hydrogen flame having a flame temperature of 2,000° C. to be hydrolyzed at a high temperature. The resultant was cooled and then collected with a filter. Thus, silica-alumina composite particles were obtained. Further, the resultant powder was heated to about 900° C. so that a chloride remaining thereon was removed.

Further, the resultant silica-alumina composite particles were loaded into an electric furnace and then heated at 1,000° C. for 20 minutes so that the crystallinity of the composite particles was increased. Thus, silica-alumina composite particles 1 were obtained.

The abundance ratio of silica single particles and alumina single particles at this time was 3.5%. Table 1 shows the other physical properties.

Production Examples of Silica-Alumina Composite Particles 2, 5, and 6

Silica-alumina composite particles 2, 5, and 6 were each obtained in the same manner as in the silica-alumina composite particles 1 except that the conditions for the post-step in the electric furnace in the production example of the silica-alumina composite particles 1 were changed as follows: at 1,180° C. for 20 minutes, no post-step, or at 1,300° C. for 20 minutes. The adjustment of the crystallinity of alumina caused a difference in dielectric characteristic among the respective particles.

In addition, increasing the crystallinity tended to increase the abundance ratio of the silica single particles and the alumina single particles. The abundance ratio of the single particles in the silica-alumina composite particles 6 was as high as 5.2%. Table 1 shows the physical properties of the respective silica-alumina composite particles.

Production Examples of Silica-Alumina Composite Particles 3, 7, and 9

Silica-alumina composite particles 3 were obtained by changing the flow rate of the aqueous solution of aluminum trichloride and the flow rate of silicon tetrachloride in the production example of the silica-alumina composite particles 1 to 0.273 kg/h and 0.277 kg/h, respectively. Similarly, silica-alumina composite particles 7 were obtained by changing the flow rate of the aqueous solution of aluminum trichloride and the flow rate of silicon tetrachloride in the production example of the silica-alumina composite particles 1 to 0.030 kg/h and 0.519 kg/h, respectively. In addition, silica-alumina composite particles 9 were obtained by changing the flow rate of the aqueous solution of aluminum trichloride and the flow rate of silicon tetrachloride in the production example of the silica-alumina composite particles 1 to 0.410 kg/h and 0.142 kg/h, respectively. The abundance ratios of the single particles of the silica-alumina composite particles 7 having a small alumina content and the silica-alumina composite particles 9 having a large alumina content were as high as 8.4% and 6.8%, respectively. Table 1 shows the physical properties of the respective silica-alumina composite particles.

Production Examples of Silica-Alumina Composite Particles 4 and 10

Silica-alumina composite particles 4 were obtained by changing the conditions for the post-step in the electric furnace in the production example of the silica-alumina composite particles 3 to at 1,180° C. for 20 minutes. In addition, silica-alumina composite particles 10 were obtained by changing the conditions for the post-step in the electric furnace in the production example of the silica-alumina composite particles 9 to at 1,300° C. for 20 minutes.

The abundance ratio of the single particles in the silica-alumina composite particles 10 was as high as 9.6%. Table 1 shows the physical properties of the respective silica-alumina composite particles.

Production Example of Silica-Alumina Composite Particles 8

Silica-alumina composite particles 8 were obtained by changing the flow rate of the aqueous solution of aluminum trichloride and the flow rate of silicon tetrachloride in the production example of the silica-alumina composite particles 4 to 0.304 kg/h and 0.247 kg/h, respectively. Table 1 shows the physical properties of the silica-alumina composite particles 8.

Production Example of Alumina Particles

An aluminum ammonium carbonate hydroxide fine powder was filtered, dried, and crushed. The fine powder was subjected to a heat treatment at 900° C. for 30 hours and then crushed so that an alumina fine powder was produced. The fine powder was dried and crushed. Thus, alumina particles having a BET specific surface area of 120 $m^2/g$ were obtained. Table 1 shows the physical properties of the alumina particles.

Production Example of Silica Particles

A silicon tetrachloride gas was atomized and introduced into an oxygen-hydrogen flame having a flame temperature of 1,200° C. through a nozzle to be hydrolyzed at a high temperature. Thus, silica particles were produced. The particles were cooled and then collected with a filter. Table 1 shows the physical properties of the silica particles.

TABLE 1

Physical properties of added particles

| | BET specific surface area ($m^2/g$) | Alumina content (mass %) | Crystallinity of alumina (%) | Volume resistivity ($\Omega \cdot m$) | Dielectric dissipation factor at 1,000 Hz (tanδ) |
|---|---|---|---|---|---|
| Silica-alumina composite particles 1 | 132 | 25.1 | 12.1 | $2.30 \times 10^8$ | 0.80 |
| Silica-alumina composite particles 2 | 130 | 25.4 | 48.2 | $3.20 \times 10^8$ | 0.41 |
| Silica-alumina composite particles 3 | 135 | 49.6 | 13.6 | $9.60 \times 10^7$ | 0.37 |
| Silica-alumina composite particles 4 | 133 | 48.9 | 48.6 | $1.30 \times 10^8$ | 0.22 |
| Silica-alumina composite particles 5 | 131 | 25.2 | 0.5 | $1.10 \times 10^7$ | 0.48 |
| Silica-alumina composite particles 6 | 128 | 24.6 | 60.1 | $4.00 \times 10^8$ | 0.01 |
| Silica-alumina composite particles 7 | 138 | 5.5 | 14.2 | $3.60 \times 10^7$ | 0.01 |
| Silica-alumina composite particles 8 | 137 | 55.1 | 49.1 | $4.80 \times 10^7$ | 0.01 |
| Silica-alumina composite particles 9 | 145 | 74.3 | 15.2 | $9.80 \times 10^6$ | 0.13 |
| Silica-alumina composite particles 10 | 140 | 75.2 | 63.2 | $1.10 \times 10^7$ | 0.01 |
| Alumina particles | 120 | 100 | 14.2 | $2.30 \times 10^{10}$ | 0.01 |
| Silica particles | 91 | 0 | — | $2.10 \times 10^{14}$ | 0.01 |

Production Example of Magnetic Carrier Core A

A magnetic carrier core A was produced with the materials shown below.

$Fe_2O_3$: 65.9 parts by mass $MnCO_3$: 29.1 parts by mass $Mg(OH)_2$: 4.5 parts by mass $SrCO_3$: 0.5 part by mass The respective materials were wet-mixed and then calcined at 900° C. for 2 hours. The calcined ferrite composition was pulverized with a ball mill. The resultant pulverized product had a number-average particle diameter of 0.8 μm. Water (300 parts by mass with respect to 100 parts by mass of the pulverized product) and a polyvinyl alcohol having a weight-average molecular weight of 5,100 (3 parts by mass with respect to 100 parts by mass of the pulverized product) were added to the resultant pulverized product, and then the mixture was granulated with a spray dryer.

Next, the granulated product was sintered in an electric furnace under a nitrogen atmosphere having an oxygen concentration of 2.5% at 1,250° C. for 6 hours, followed by pulverization. Further, the pulverized product was classified. Thus, a magnetic carrier core A having Mn—Mg—Sr—Fe ferrite composition was obtained. The resultant magnetic carrier core A had a 50% particle diameter (D50) on a volume basis of 35.3 μm. In addition, as a result of the measurement of its specific resistance, the specific resistance in 300 V/cm was $2.7 \times 10^8$ (Ω·cm).

Production Example of Magnetic Carrier Core B

A silane-based coupling agent (3-(2-aminoethylaminopropyl)trimethoxysilane) was added at ratios of 4.0 mass % and 4.0 mass % with respect to magnetite fine particles (having a number-average particle diameter of 0.3 μm) and hematite fine particles (having a number-average particle diameter of 0.6 μm), respectively, and then the contents were mixed and stirred at 100° C. or more and at a high speed in a vessel so that the respective fine particles were subjected to a lipophilic treatment.

Phenol: 10 parts by mass

Formaldehyde solution (37-mass % aqueous solution of formaldehyde): 6 parts by mass Magnetite fine particles treated as described above: 76 parts by mass Hematite fine particles treated as described above: 8 parts by mass The foregoing materials, 5 parts by mass of 28-mass % ammonia water, and 25 parts by mass of water were loaded into a flask, and then the temperature of the contents was increased to 85° C. in 30 minutes while the contents were mixed. The mixture was held at the temperature and subjected to a polymerization reaction for 3 hours to be cured. After that, the resultant was cooled to 30° C., and then water was further added to the resultant. After that, the supernatant was removed, and then the precipitate was washed with water, followed by air-drying. Next, the resultant was dried under reduced pressure (5 hPa or less) at a temperature of 60° C. Thus, a magnetic fine particle-dispersed magnetic carrier core B having magnetite particles dispersed in a phenol resin was obtained. The resultant magnetic carrier core B had a 50% particle diameter (D50) on a volume basis of 36.2 μm. In addition, as a result of the measurement of its specific resistance, the specific resistance in 300 V/cm was $2.0\times10^{9}$ (Ω·cm).

Production Example of Resin Composition Particles 1

First, 100.0 parts by mass of methanol and 200.0 parts by mass of methyl ethyl ketone as solvents were charged into a four-necked separable flask provided with a stirring machine, a condenser, a temperature gauge, and a nitrogen-introducing pipe. Further, 200.0 parts by mass of a methyl methacrylate monomer, 300.0 parts by mass of a cyclohexyl methacrylate monomer, and 3.0 parts by mass of azobisisovaleronitrile as a polymerization initiator were loaded into the flask. In this state, the mixture was subjected to a solution polymerization reaction for 12 hours at 65° C. under stirring and the introduction of nitrogen. Thus, a polymerized solution was obtained.

Next, 500 parts by mass of hexane-exchanged water were charged into a four-necked separable flask provided with a stirring machine, a Liebig condenser, and a temperature gauge. Further, 100.0 parts by mass of the polymerized solution were charged into the hexane-exchanged water, and then the mixture was subjected to deliquoring while being stirred under heating at 95° C. for 10 hours. Thus, a resin dispersion solution was obtained. The resultant resin dispersion solution was separated by filtration so that a resin component was obtained. The resin component was dried at 50° C. until a resin content therein became 99.5% or more. Thus, resin coarse particles were obtained.

The resultant resin coarse particles were finely pulverized with a pulverizer. Thus, finely pulverized particles having a 50% particle diameter (D50) on a volume basis of 7.1 μm were obtained. Further, the resultant finely pulverized particles were classified with an air classifier. Thus, resin composition particles 1 having a 50% particle diameter (D50) on a volume basis of 1.2 μm were obtained. It should be noted that the resultant resin composition particles 1 had a weight-average molecular weight Mw of 49,000, and the resin component in the particles had a glass transition temperature (Tg) of 101.0° C.

Production Example of Toner 1

Polyester resin (having a peak molecular weight Mp of 6,500 and Tg of 65° C.) (prepared with 65 mol % of bisphenol A-propylene oxide adduct, 35 mol % of bisphenol A-ethylene oxide adduct, 65 mol % of telephthalic acid, and 6 mol % of trimellitic acid): 100.0 parts by mass C.I. Pigment Blue 15:3: 5.0 parts by mass Paraffin wax (having a melting point of 75° C.) 5.0 parts by mass Aluminum 3,5-di-t-butylsalicylate compound: 0.5 part by mass The foregoing materials were mixed with a HENSCHEL mixer. After that, the mixture was melted and kneaded with a biaxial extruder. The resultant kneaded product was cooled and coarsely pulverized with a coarse pulverizer to have a particle diameter of 1 mm or less. Thus, a coarsely pulverized product was obtained. The resultant coarsely pulverized product was finely pulverized with a pulverizer and then classified with an air classifier. Thus, toner particles were obtained. The resultant toner particles had a 50% particle diameter (D50) on a volume basis of 6.5 μm.

The following materials were externally added to 100.0 parts by mass of the resultant toner particles with a HENSCHEL mixer. Thus, a toner 1 was produced.

Anatase-type titanium oxide fine powder (having a BET specific surface area of 80 $m^2/g$; treated with 12 mass % of isobutyl trimethoxysilane): 1.0 part by mass Oil-treated silica (having a BET specific surface area of 95 $m^2/g$; treated with 15 mass % of silicone oil): 1.5 parts by mass Sol-gel method spherical silica (treated with hexamethyldisilazane; having a BET specific surface area of 24 $m^2/g$; number-average particle diameter of 0.1 μm): 1.5 parts by mass Production Example of Magnetic Carrier 1

In the production of a magnetic carrier 1, a coating treatment was performed with the apparatus illustrated in FIG. 1 in which the main body casing 1 had an inner diameter of 130 mm and the driving portion 8 had a rating power of 5.5 kW.

Further, the magnetic carrier 1 was produced with the following materials by employing the following production method with a space volume B of the minimum gap between the inner peripheral surface of the main body casing 1 and the stirring members 3 set to $2.7\times10^{-4}$ $m^3$, and the maximum width D of each of the stirring members 3 set to 25.0 mm.

Here, a volume A of the magnetic carrier core A, the resin composition particles 1, and the silica-alumina composite particles 1 as objects to be treated was set to $5.7\times10^{-4}$ $m^3$, and a ratio A/B as a relationship between the volume A, and the space volume B of the minimum gap between the inner peripheral surface of the main body casing 1 and the stirring members was set to 2.1.

In addition, as illustrated in FIG. 4, a length E of a rotor 18 constructing the rotation body 2 was adjusted so that the overlapping width C of the stirring member 3*a* and the stirring member 3*b* was set to 4.3 mm, and a ratio C/D as a relationship between the overlapping width C and the width D of each of the stirring members 3 was set to 0.17.

0.2 Part by mass of the silica-alumina composite particles 1 and 0.5 part by mass of the resin composition particles 1 were mixed in advance. The mixture of those particles was added to the apparatus, and then 100.0 parts by mass of the magnetic carrier core A were further added to the apparatus. The mixture was subjected to a coating treatment for a treatment time of 15 minutes while the power of the driving portion 8 and the peripheral speed of the outermost end portion of each of the stirring members 3 were adjusted so as to have constant values of 3.5 kW and 11 m/sec, respectively.

After that, 1.5 parts by mass of the resin composition particles 1 were further added to 100.0 parts by mass of the magnetic carrier core A, and then the mixture was subjected to a coating treatment for a treatment time of 15 minutes while the power of the driving portion 8 was adjusted so as to have a constant value of 3.5 kW.

The resultant magnetic carrier was subjected to magnetic separation, and then residual resin composition particles were separated with a circular vibrating sieve mounted with a screen having a diameter of 500 mm and an aperture of 75 μm. Thus, a magnetic carrier 1 was obtained. Table 2 shows the formulation and physical properties of the resultant magnetic carrier 1. As a result of the observation of the surface of the magnetic carrier 1 with an electron microscope, no exposure of the silica-alumina composite particles was found. Therefore, the magnetic carrier 1 is considered to contain the silica-alumina composite particles in the lower layer of the resin coating layer. In addition, as a result of the measurement of the specific resistance of the magnetic carrier 1, the specific resistance in 1,000 V/cm was $3.2\times10^{10}$ (Ω·cm).

Production Examples of Magnetic Carriers 2 to 10

Magnetic carriers 2 to 10 were obtained in the same manner as in the production example of the magnetic carrier 1 except that material formulations and apparatus conditions were changed as shown in Table 2. Table 2 shows the physical properties of the resultant magnetic carriers.

Production Example of Magnetic Carrier 11

A mixture obtained by mixing 0.2 part by mass of the silica-alumina composite particles 8 and 0.8 part by mass of the resin composition particles 1 was added to the apparatus illustrated in FIG. 1, and then 100.0 parts by mass of the magnetic carrier core A were further added to the apparatus. In addition, the midstream addition of the resin composition particles 1 was not performed. A magnetic carrier 11 was obtained in the same manner as in the production example of the magnetic carrier 1 except the foregoing. Table 2 shows the physical properties of the resultant magnetic carrier.

Production Example of Magnetic Carrier 12

A magnetic carrier 12 was obtained in the same manner as in the production example of the magnetic carrier 1 except that materials shown in Table 2 were used. Table 2 shows the physical properties of the resultant magnetic carrier.

Production Example of Magnetic Carrier 13

A magnetic carrier 13 was obtained in the same manner as in the production example of the magnetic carrier 11 except that the carrier core A was changed to the carrier core B. Table 2 shows the physical properties of the resultant magnetic carrier.

Production Example of Magnetic Carrier 14

60 Parts by mass of a cyclohexyl methacrylate monomer having an ester moiety and a cyclohexyl as a unit and 40 parts by mass of a methyl methacrylate monomer were added to a four-necked flask having a reflux condenser, a temperature gauge, a nitrogen-sucking pipe, and a grinding type stirring apparatus. Further, 90 parts by mass of toluene, 100 parts by mass of methyl ethyl ketone, and 3.0 parts by mass of azobisisovaleronitrile were added to the flask. The resultant mixture was held in a stream of nitrogen at 70° C. for 13 hours. After the completion of a polymerization reaction, washing was repeated. Thus, a graft copolymer solution (having a solid content of 33 mass %) was obtained. The solution had a weight-average molecular weight measured by gel permeation chromatography (GPC) of 58,000. In addition, its Tg was 98° C. The solution is defined as a copolymer solution 1.

The copolymer solution 1 and the silica-alumina composite particles 8 were loaded at the following ratio into a mayonnaise jar (cylindrical shape, 450 ml) together with 80 parts by mass of glass beads each having a particle diameter of 2 mm, and were then dispersed with a paint shaker.

Copolymer solution 1 (having a solid content of 33 mass %): 100.0 parts by mass

Silica-alumina composite particles 8: 8.3 parts by mass

The glass beads were separated by filtration with a nylon mesh, and then toluene was added to the resultant dispersion solution so that a solid content was 10 mass %. The mixture of the materials and a carrier core were loaded into a Nauta Mixer (manufactured by Hosokawa Micron Corporation), and were then stirred at 60° C. for 1 hour. After that, the resultant was sintered at 100° C. for 2 hours. Further, the sintered product was sieved. Thus, a magnetic carrier 14 was obtained. Table 2 shows the physical properties of the resultant magnetic carrier 14.

Production Examples of Magnetic Carriers 15 to 17

Magnetic carriers 15 to 17 were obtained in the same manner as in the production example of the magnetic carrier 1 except that material formulations and apparatus conditions were changed as shown in Table 2. Table 2 shows the physical properties of the resultant magnetic carriers.

TABLE 2

Formulations and physical properties of magnetic carriers

| Magnetic carrier name | Magnetic carrier core name | Resin composition particles: Composition | Resin composition particles: Addition amount (mass %) | Added particles: Kind | Added particles: Addition amount (mass %) | Coating method | Volume resistivity of magnetic carrier (Ω · cm) |
|---|---|---|---|---|---|---|---|
| Magnetic carrier 1 | Magnetic carrier core A | CHMA/MMA | 0.5 + 1.5 | Silica-alumina composite particles 1 | 0.2 | Coating treatment with apparatus of FIG. 1 | $3.2 \times 10^{10}$ |
| Magnetic carrier 2 | Magnetic carrier core A | CHMA/MMA | 0.5 + 1.5 | Silica-alumina composite particles 2 | 0.2 | Coating treatment with apparatus of FIG. 1 | $2.2 \times 10^{10}$ |
| Magnetic carrier 3 | Magnetic carrier core A | CHMA/MMA | 0.5 + 1.5 | Silica-alumina composite particles 3 | 0.2 | Coating treatment with apparatus of FIG. 1 | $3.2 \times 10^{10}$ |

TABLE 2-continued

Formulations and physical properties of magnetic carriers

| Magnetic carrier name | Magnetic carrier core name | Resin composition particles: Composition | Resin composition particles: Addition amount (mass %) | Added particles: Kind | Added particles: Addition amount (mass %) | Coating method | Volume resistivity of magnetic carrier (Ω · cm) |
|---|---|---|---|---|---|---|---|
| Magnetic carrier 4 | Magnetic carrier core A | CHMA/MMA | 0.5 + 1.5 | Silica-alumina composite particles 4 | 0.2 | Coating treatment with apparatus of FIG. 1 | $4.2 \times 10^{10}$ |
| Magnetic carrier 5 | Magnetic carrier core A | CHMA/MMA | 0.5 + 1.5 | Silica-alumina composite particles 5 | 0.2 | Coating treatment with apparatus of FIG. 1 | $2.1 \times 10^{10}$ |
| Magnetic carrier 6 | Magnetic carrier core A | CHMA/MMA | 0.5 + 1.5 | Silica-alumina composite particles 6 | 0.2 | Coating treatment with apparatus of FIG. 1 | $3.8 \times 10^{10}$ |
| Magnetic carrier 7 | Magnetic carrier core A | CHMA/MMA | 0.5 + 1.5 | Silica-alumina composite particles 7 | 0.2 | Coating treatment with apparatus of FIG. 1 | $1.5 \times 10^{10}$ |
| Magnetic carrier 8 | Magnetic carrier core A | CHMA/MMA | 0.5 + 1.5 | Silica-alumina composite particles 8 | 0.2 | Coating treatment with apparatus of FIG. 1 | $2.3 \times 10^{10}$ |
| Magnetic carrier 9 | Magnetic carrier core A | CHMA/MMA | 0.5 + 1.5 | Silica-alumina composite particles 9 | 0.2 | Coating treatment with apparatus of FIG. 1 | $1.1 \times 10^{10}$ |
| Magnetic carrier 10 | Magnetic carrier core A | CHMA/MMA | 0.5 + 1.5 | Silica-alumina composite particles 10 | 0.2 | Coating treatment with apparatus of FIG. 1 | $1.9 \times 10^{10}$ |
| Magnetic carrier 11 | Magnetic carrier core A | CHMA/MMA | 0.8 | Silica-alumina composite particles 8 | 0.2 | Coating treatment with apparatus of FIG. 1 | $6.7 \times 10^{9}$ |
| Magnetic carrier 12 | Magnetic carrier core B | CHMA/MMA | 0.5 + 1.5 | Silica-alumina composite particles 8 | 0.2 | Coating treatment with apparatus of FIG. 1 | $7.1 \times 10^{12}$ |
| Magnetic carrier 13 | Magnetic carrier core B | CHMA/MMA | 0.8 | Silica-alumina composite particles 8 | 0.2 | Coating treatment with apparatus of FIG. 1 | $6.8 \times 10^{11}$ |
| Magnetic carrier 14 | Magnetic carrier core B | CHMA/MMA | 0.8 | Silica-alumina composite particles 8 | 0.2 | Immersion method | $8.6 \times 10^{10}$ |
| Magnetic carrier 15 | Magnetic carrier core A | CHMA/MMA | 0.5 + 1.5 | Alumina particles | 0.2 | Coating treatment with apparatus of FIG. 1 | $5.4 \times 10^{11}$ |
| Magnetic carrier 16 | Magnetic carrier core A | CHMA/MMA | 0.5 + 1.5 | Silica particles | 0.2 | Coating treatment with apparatus of FIG. 1 | $7.8 \times 10^{11}$ |
| Magnetic carrier 17 | Magnetic carrier core A | CHMA/MMA | 0.5 + 1.5 | Mixture of alumina particles and silica | 0.1 + 0.1 | Coating treatment with apparatus of FIG. 1 | $6.5 \times 10^{11}$ |

Example 1

10 Parts by mass of the toner 1 were added to 90 parts by mass of the magnetic carrier 1, and then the mixture was shaken with a V type mixer for 10 minutes so that a two-component developer was prepared. The following evaluations were performed with the two-component developer. Table 3 shows the results.

<Evaluation for Developing Performance>

An evaluation was performed with a full-color copying machine image RUNNER ADVANCE C5051 manufactured by Canon Inc. as an image-forming apparatus. Auto carrier refresh development is performed in the apparatus. In this evaluation, however, the apparatus was constructed by closing the discharge port of a magnetic carrier so as to perform the evaluation by being replenished only with toner. Further, an AC voltage as a rectangular wave having a frequency of 2.0 kHz and a Vpp of 1.7 kV, and a DC voltage Vdc were applied to a developing sleeve.

An endurance image output test (A4 horizontal, print percentage: 5%, continuous passing of 40,000 sheets) was performed under each of a normal-temperature, normal-humidity environment (23° C., 50% RH) and a high-temperature, high-humidity environment (32.5° C., 80% RH). After the completion of the image output, the images were left to stand under the environment for 5 days, and then an evaluation for fogging was performed. During the time period of the continuous passing of 40,000 sheets, paper passing is performed under the same development and transfer conditions as those of the first sheet. A copy paper CS-814 (A4, basis weight: 81.4 g/m$^2$; distributed from Canon Marketing Japan Inc.) was used as evaluation paper. The toner laid-on level of an FFH image (solid portion) on the paper in the evaluation environment was adjusted to 0.4 mg/cm$^2$. The term "FFH image" refers to a 256-th gray level (solid portion) when an image density is represented in terms of 256 gray levels and OOH is defined as the first gray level (white portion).

The items and evaluation criteria of image output evaluations at an initial stage (first sheet) and at the time of the continuous passing of 40,000 sheets are described below.

(Measurement of Image Densities at Initial Stage (First Sheet) and at Time of Output of 10,000 Sheets)

The image densities of the FFH image portions (solid portions) of images at the initial stage (first sheet) and the 10,000-th sheet were measured with an X-Rite Color Reflection Densitometer (500 series: manufactured by X-Rite). A difference in image density between the FFH image portions (solid portions) of the images at the initial stage (first sheet) and the 10,000-th sheet was evaluated by the following criteria.

(Evaluation Criteria)

A: The difference in density is less than 0.05 (extremely excellent).

B: The difference in density is 0.05 or more and less than 0.10 (good).

C: The difference in density is 0.10 or more and less than 0.20 (at such a level that no problems arise in the present invention).

D: The difference in density is 0.20 or more (unacceptable in the present invention).

(00H Image Portions at Initial Stage (First Sheet), after Endurance, and after Standing; Measurement of Fogging of White Portion)

An average reflectance Dr (%) of the evaluation paper before the image output was measured with a reflectometer ("REFLECTOMETER MODEL TC-6DS" manufactured by Tokyo Denshoku Co., Ltd.).

Next, a reflectance Ds (%) of each of the white portions at the initial stage (first sheet) and the 10,000-th sheet was measured. Fogging (%) was calculated from the resultant Dr and Ds by using the following equation. The resultant fogging was evaluated in accordance with the following evaluation criteria.

$$\text{Fogging}(\%)=Dr(\%)-Ds(\%)$$

(Evaluation Criteria)

A: The fogging is less than 0.5% (extremely excellent).

B: The fogging is 0.5% or more and less than 1.0% (good).

C: The fogging is 1.0% or more and less than 2.0% (at such a level that no problems arise in the present invention).

D: The fogging is 2.0% or more (unacceptable in the present invention).

In addition, an evaluation for fogging after the standing was performed by the same criteria as those described above.

<Carrier Adhesion>

A solid white image was output on plain paper with the image-forming apparatus while its Vback was changed to 200V. After that, a transparent adhesive tape was brought into close contact with a region between a cleaner portion and a developing portion on a photosensitive drum so that sampling was performed. Then, the number of magnetic carrier particles adhering onto the photosensitive drum per 1 cm×1 cm was counted, and then the number of adhering magnetic carrier particles per 1 $cm^2$ was calculated.

(Evaluation Criteria)

A: The number of adhering magnetic carrier is less than 10 particles/$cm^2$ (extremely excellent).

B: The number of adhering magnetic carrier is 10 particles/$cm^2$ or more and less than 20 particles/$cm^2$ (good).

C: The number of adhering magnetic carrier is 20 particles/$cm^2$ or more and less than 50 particles/$cm^2$ (at such a level that no problems arise in the present invention).

D: The number of adhering magnetic carrier is 50 particles/$cm^2$ or more and less than 100 particles/$cm^2$ (unacceptable in the present invention).

E: The number is 100 particles/$cm^2$ or more.

Examples 2 to 14 and Comparative Examples 1 to 3

Two-component developers were produced in the same manner as in Example 1 except that the toner 1 and magnetic carriers shown in Table 3 were combined. Table 3 shows the results of the evaluations of the respective two-component developers.

TABLE 3

Examples and results of evaluations

| | | NN environment (initial stage) | | NN environment (after printing on 40k sheets) | | | | HH environment (initial stage) | | HH environment (after printing on 40k sheets) | | | |
|---|---|---|---|---|---|---|---|---|---|---|---|---|---|
| | | | | | Fogging | | | | | | Fogging | | |
| | Kind of carrier | Image density | Fogging | Image density | Fogging | after standing | Carrier adhesion | Image density | Fogging | Image density | Fogging | after standing | Carrier adhesion |
| Example 1 | Magnetic carrier 1 | A (0.02) | A (0.1) | A (0.02) | A (0.3) | A (0.4) | A | A (0.02) | A (0.3) | A (0.03) | A (0.4) | A (0.4) | A |
| Example 2 | Magnetic carrier 2 | A (0.02) | A (0.2) | A (0.02) | A (0.3) | A (0.4) | A | A (0.02) | A (0.2) | A (0.03) | A (0.4) | A (0.4) | A |
| Example 3 | Magnetic carrier 3 | A (0.01) | A (0.3) | A (0.02) | A (0.4) | A (0.4) | A | A (0.04) | A (0.3) | A (0.03) | A (0.4) | B (0.8) | B |
| Example 4 | Magnetic carrier 4 | A (0.04) | A (0.2) | A (0.04) | B (0.6) | B (0.8) | A | A (0.03) | A (0.3) | A (0.04) | A (0.4) | B (0.9) | B |
| Example 5 | Magnetic carrier 5 | A (0.04) | A (0.3) | B (0.06) | B (0.6) | B (0.7) | A | A (0.02) | A (0.4) | B (0.06) | B (0.6) | B (0.8) | B |
| Example 6 | Magnetic carrier 6 | A (0.03) | A (0.2) | B (0.05) | B (0.6) | B (0.9) | A | A (0.03) | A (0.4) | B (0.07) | B (0.8) | B (0.9) | B |
| Example 7 | Magnetic carrier 7 | A (0.02) | A (0.4) | A (0.03) | B (0.6) | B (0.8) | A | A (0.02) | A (0.3) | A (0.03) | B (0.6) | B (0.7) | B |
| Example 8 | Magnetic carrier 8 | A (0.04) | A (0.3) | A (0.04) | B (0.7) | C (1.3) | B | A (0.03) | B (0.4) | B (0.06) | B (0.8) | C (1.7) | B |
| Example 9 | Magnetic carrier 9 | A (0.02) | A (0.3) | A (0.03) | B (0.6) | B (0.9) | B | A (0.04) | A (0.4) | A (0.04) | B (0.6) | B (0.9) | C |
| Example 10 | Magnetic carrier 10 | A (0.04) | A (0.3) | B (0.07) | B (0.9) | B (0.9) | B | A (0.04) | A (0.3) | B (0.05) | C (1.4) | C (1.7) | C |
| Example 11 | Magnetic carrier 11 | A (0.03) | A (0.3) | B (0.07) | B (0.7) | C (1.2) | B | A (0.03) | A (0.4) | C (0.18) | B (0.8) | C (1.8) | C |
| Example 12 | Magnetic carrier 12 | A (0.03) | A (0.4) | B (0.06) | B (0.8) | C (1.4) | B | A (0.03) | A (0.4) | B (0.07) | B (0.7) | C (1.6) | B |
| Example 13 | Magnetic carrier 13 | A (0.03) | A (0.4) | B (0.07) | B (0.9) | C (1.6) | C | A (0.04) | A (0.4) | C (0.19) | B (0.6) | C (1.9) | C |
| Example 14 | Magnetic carrier 14 | A (0.03) | A (0.4) | C (0.15) | B (0.8) | C (1.4) | B | A (0.03) | A (0.4) | C (0.18) | B (0.8) | C (1.8) | C |
| Comparative Example 1 | Magnetic carrier 15 | A (0.03) | A (0.3) | C (0.15) | B (0.7) | C (1.2) | D | A (0.03) | A (0.4) | C (0.19) | D (2.2) | D (2.2) | D |
| Comparative Example 2 | Magnetic carrier 16 | A (0.04) | A (0.4) | C (0.19) | B (0.8) | C (1.6) | D | A (0.03) | A (0.3) | C (0.19) | D (2.3) | D (2.4) | D |
| Comparative Example 3 | Magnetic carrier 17 | A (0.04) | A (0.4) | C (0.15) | B (0.8) | C (1.4) | D | A (0.03) | A (0.3) | C (0.19) | D (2.2) | D (2.3) | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-107073, filed May 12, 2011, which is hereby incorporated by reference herein in its entirety.

REFERENCE SIGNS LIST

1 main body casing
2 rotation body
3, 3*a*, 3*b* stirring member
4 jacket
5 raw material inlet
6 outlet
7 center shaft
8 driving portion
10 rotation body end side surface
11 counterclockwise direction
12 feed direction (direction to driving portion)
13 feed direction (direction opposite to driving portion)
14 trajectory of stirring member generated by rotation of rotation body
15 rotation volume calculated from trajectory of stirring member generated by rotation of rotation body
16 inner piece for raw material inlet
17 inner piece for product outlet
18 rotor
B space volume of minimum gap between inner peripheral surface of main body casing and stirring member
C distance representing overlapping portion of stirring members
D width of stirring member
E rotor length
21 lower electrode
22 upper electrode
27 sample (silica-alumina composite particles)

The invention claimed is:

1. A magnetic carrier, comprising:
a magnetic carrier core; and
a resinous coating layer formed on a surface of the magnetic carrier core,
wherein the resinous coating layer contains a resin composition and silica-alumina composite particles, and
wherein the silica-alumina composite particles have a dielectric dissipation factor at 1,000 Hz of 0.02 or more and 1.00 or less.

2. The magnetic carrier according to claim 1, wherein a content of alumina in the silica-alumina composite particles is 5.0 mass % or more and 50.0 mass % or less.

3. The magnetic carrier according to claim 1, wherein a crystallinity of alumina in the silica-alumina composite particles is 1.0% or more and 60.0% or less.

4. The magnetic carrier according to claim 1, wherein the silica-alumina composite particles are produced by a gas phase method.

* * * * *